United States Patent [19]

Marom et al.

[11] Patent Number: 4,888,724

[45] Date of Patent: Dec. 19, 1989

[54] OPTICAL ANALOG DATA PROCESSING SYSTEMS FOR HANDLING BIPOLAR AND COMPLEX DATA

[75] Inventors: Emanuel Marom, Los Angeles; Yuri Owechko, Newbury Park; Bernard H. Soffer, Pacific Palisades, all of Calif.

[73] Assignee: Hughes Aircraft Company, Los Angeles, Calif.

[21] Appl. No.: 181,799

[22] Filed: Apr. 15, 1988

Related U.S. Application Data

[63] Continuation-in-part of Ser. No. 821,378, Jan. 22, 1986, abandoned, and a continuation-in-part of Ser. No. 918,954, Oct. 15, 1986, abandoned.

[51] Int. Cl.[4] ..... G06G 7/00

[52] U.S. Cl. ..... 364/807; 342/25

[58] Field of Search ..... 364/807, 822, 862, 602; 342/25

[56] References Cited

U.S. PATENT DOCUMENTS

| | | | |
|---|---|---|---|
| 3,989,355 | 11/1976 | Wilmer | 350/160 |
| 4,462,032 | 7/1984 | Martin | 342/25 |
| 4,514,821 | 4/1985 | Tower | 364/862 |
| 4,567,569 | 1/1986 | Caulfield et al. | 364/845 |
| 4,569,033 | 2/1986 | Collins et al. | 364/845 |
| 4,588,260 | 5/1986 | Herner | 364/822 X |
| 4,594,593 | 6/1986 | Nohmi | 342/25 |
| 4,595,994 | 6/1986 | Vesber et al. | 364/841 |
| 4,603,398 | 7/1986 | Bocker et al. | 364/545 |
| 4,607,344 | 8/1986 | Athale et al. | 364/845 X |
| 4,613,204 | 9/1986 | Vesber et al. | 364/821 X |
| 4,626,293 | 10/1986 | Schlurt et al. | 364/845 |
| 4,633,428 | 12/1986 | Byron | 364/845 X |
| 4,724,418 | 2/1988 | Weindling | 342/25 |
| 4,758,838 | 7/1988 | Maeda et al. | 342/25 |

FOREIGN PATENT DOCUMENTS

| | | |
|---|---|---|
| 57-198434 | 2/1983 | Japan . |
| 8605608 | 9/1986 | World Int. Prop. O. . |

OTHER PUBLICATIONS

"Pipelined polynomial processors implemented with integrated optical components" Verber et al., Applied Optics, vol. 23, No. 6, 3/15/84, (New York, U.S.), pp. 817–821.

C. Elachi et al, "Spaceborne Synthetic-Aperture Imaging Radars: Applications, Techniques and Technology," Proc. IEEE, vol. 70, No. 10, Oct. 1982, pp. 1174–1209.

L. J. Cutrona et al, "On the Application of Coherent Optical Processing Techniques to Synthetic-Aperture Radar," Proc. IEEE, vol. 54, No. 8, Aug. 1966, pp. 1026–1032.

J. W. Goodman, *Introduction to Fourier Optics*, McGraw-Hill Book Company, 1968, at Sec. 7-7, pp. 184–192.

K. Bromley et al, "An Electro-Optical Signal Processing Module," Proc. 180 SPIE, Washington, D.C., Apr. 1979, pp. 107–113.

D. Psaltis et al, "High Speed Techniques for Synthetic Aperture Radar Image Formation," NASA Conference Publication 2207, Optical Information Processing for Aerospace Applications, Aug. 18–19, 1981, p. 47 et seq.

J. Grinberg et al, "Programmable Real-Time Incoherent Matrix Multiplier for Optical Processing", Topical Meeting on Optical Computing, Mar. 18–20, 1985, Incline Village, Nevada.

T. Henwood, "SAR: An Imaging Tool for the 80s and Beyond" Photonics Spectra, Jun. 1986, pp. 119, 120, 122, 124 and 126.

A. B. E. Ellis, "The Processing of Synthetic Aperture Radar Signals," GEC Journal of Research, vol. 2, No. 3, 1984, pp. 169 through 177.

*Primary Examiner*—MacDonald Allen

*Attorney, Agent, or Firm*—V. D. Duraiswamy; W. K. Denson-Low

[57] ABSTRACT

Optical analog data processing systems are described for handling both bipolar and complex data. Multi-cell spatial light modulators are employed in which a plurality of modulation areas are used in conjunction with space and time mutliplexed configurations to process bipolar and complex data elements. Multi-cell light detector arrays are used to convert modulated light into signals representing the processed data. The processing systems are capable of real time processing of synthetic aperture radar data.

28 Claims, 12 Drawing Sheets

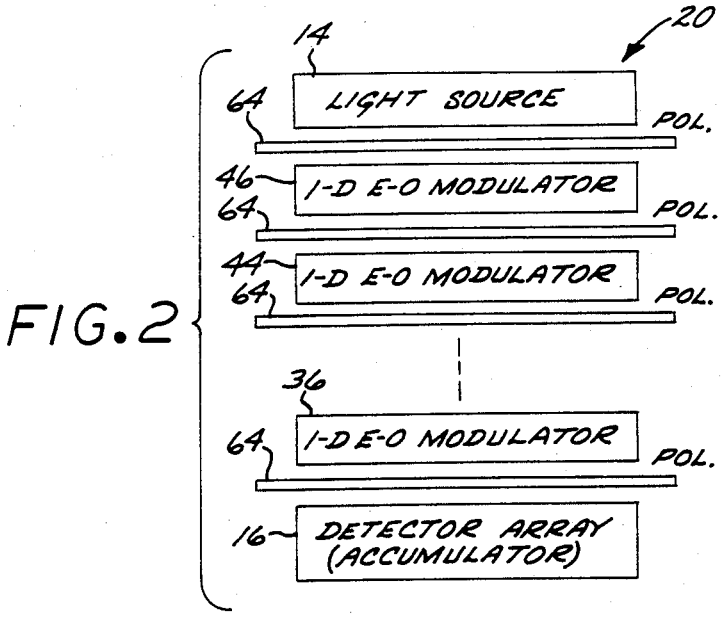
FIG. 2
FIG. 3
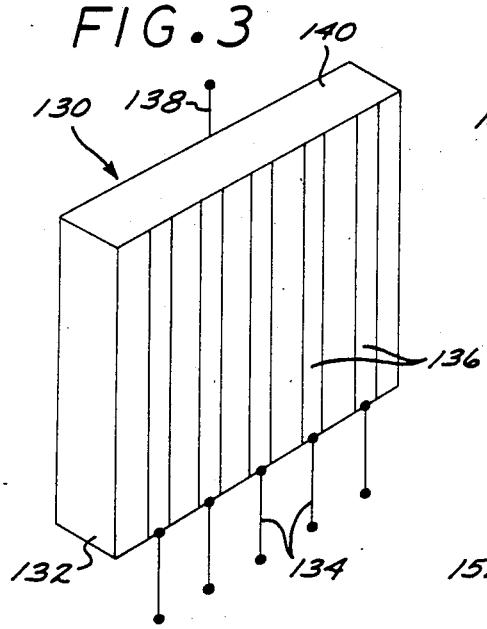
FIG. 4
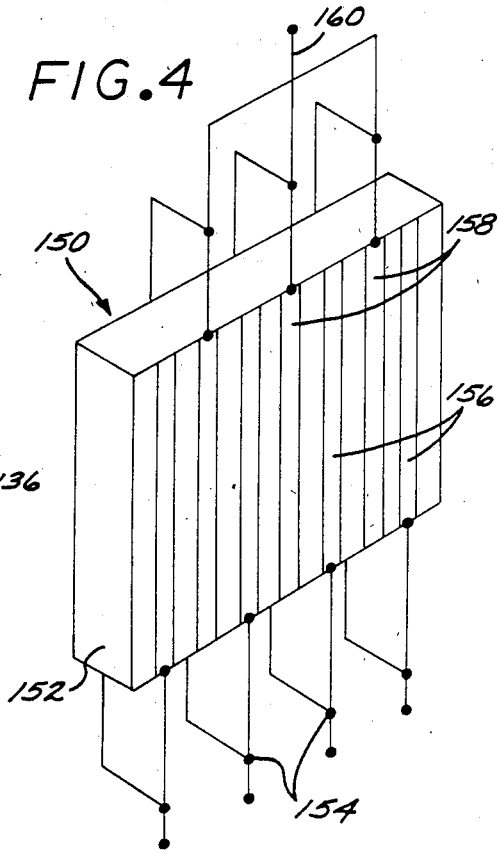

FIG. 7a
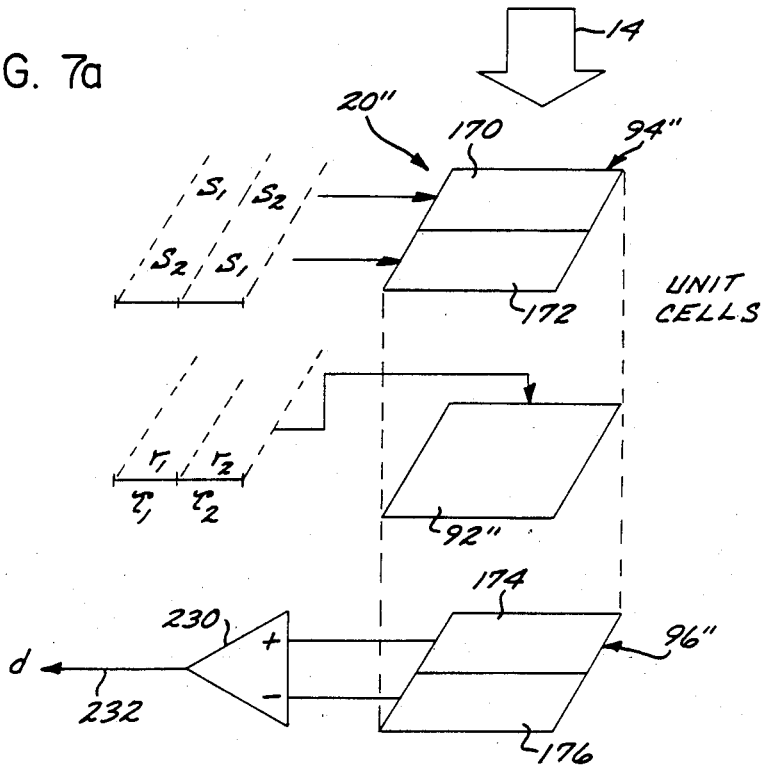
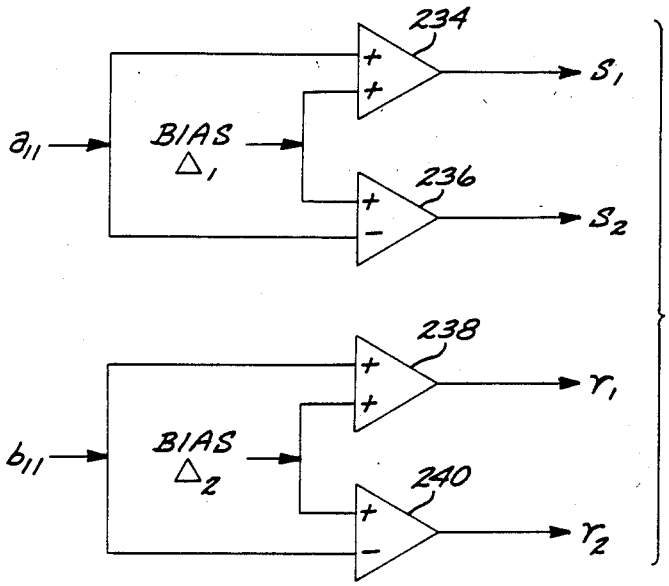
FIG. 7b

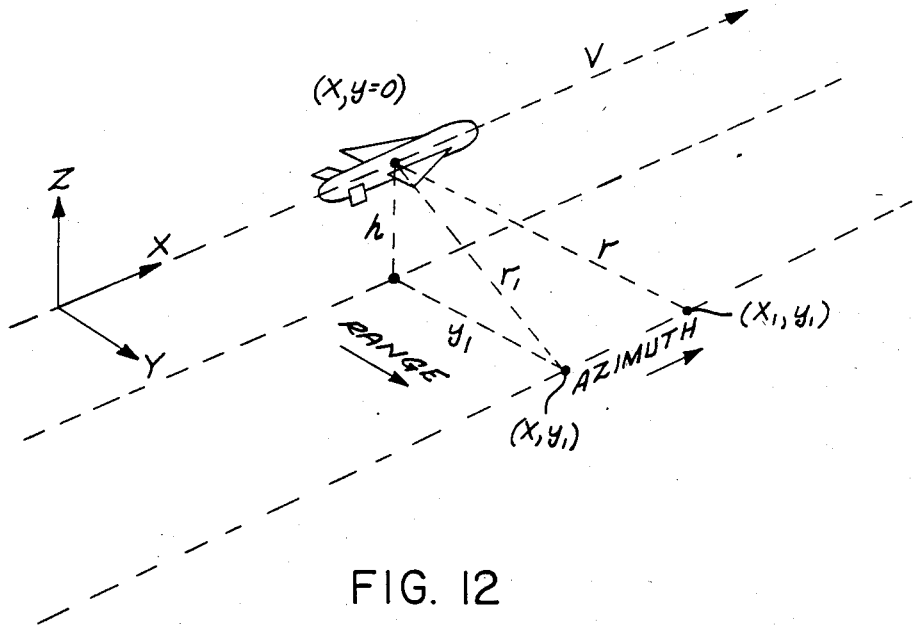
FIG. 12
FIG. 13
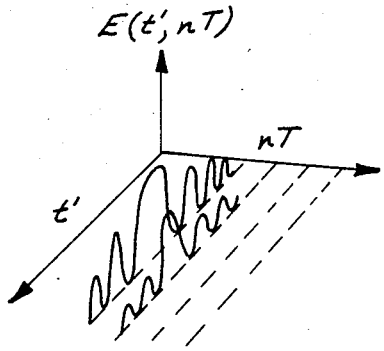

OPTICAL ANALOG DATA PROCESSING SYSTEMS FOR HANDLING BIPOLAR AND COMPLEX DATA

CROSS-REFERENCE TO RELATED APPLICATIONS

This application is a continuation-in-part of commonly assigned Application Ser. No. 06/821,378 filed on Jan. 22, 1986, now abandoned and commonly assigned Application Ser. No. 06/918,954 filed on Oct. 15, 1986, now abandoned, the entire disclosures of which are incorporated herein by reference.

FIELD OF INVENTION

The present invention generally relates to optical computing and data processing systems and, in particular, to multistage lensless optical analog data processors capable of processing bipolar and complex data, for example, real time processing of synthetic aperture radar data.

BACKGROUND OF THE INVENTION

Optical processing of vector and matrix data is known for its potentially highly effective computational performance capabilities and its natural adaptability to computationally intensive image processing. Images, or other spatially relatable data, may be treated as matrices composed of raster or vector scans of data elements that, at their real or effective resolution limit, are generally referred to as pixels. An ordinary image is typified by an analog picture frame taken as a cross section of an optical beam formed of a continuous series of such images. Each analog image frame typically contains an effectively continuous spatially distributed array of pixel data. Alternatively, discrete matrix data may be impressed onto a data beam by spatially modulating the cross section of a data beam in terms of, for example, either its localized intensity or polarization vector.

In any case, optical processing is of great potential value due to its fundamentally parallel processing nature. The parallelism, of course, arises due to the processing of complete images at a time. As each pixel is a separate datum, the volume of data processed in parallel is generally equivalent to the effective resolution of the image. Additionally, optical processing has the virtue of processing data in the same format that it is conventionally obtained. Typically, and for such applications as image enhancement and recognition, the data to be processed is generally obtained as a single image or as a raster scan of an image frame. Potentially then, an optical processor may receive data directly without conventional or other intermediate processing. Since the informative value of image data increases with the effective resolution of the image and the number of images considered, the particular and unique attributes of optical processing become quite desirable.

Conventionally, optical processing is performed by projecting an image to be processed through a selected spatial mask onto an appropriate optical detector. A temporally variable mask for optical processors has been realized as a one-dimensional spatial light modulator (SLM) that, through electronic activation, effects selective alteration of the spatially distributed data impressed on a data beam by the mask. A typical SLM is in the form of a solid electro-optical element activated by a spatially distributed array of electrodes. The modulating image is effectively formed by separately establishing the voltage potential of each of the electrodes at an analog voltage corresponding to the respective intended data values.

Optical data processors of the type described above are disclosed in U.S. patent application Ser. No. 713,064, filed Mar. 18, 1985, entitled Programmable Multistage Lensless Optical Data Processing System, invented by Jan Grinberg and Bernard H. Soffer, and U.S. patent application Ser. No. 713,063 filed Mar. 18, 1985, entitled Programmable Methods of Performing Complex Optical Computations Using Data Processing System, invented by Jan Grinberg, Graham R. Nudd, and Bernard H. Soffer.

A limitation in the use of these optical data processors is that they are designed to handle analog positive numbers only. This is so because these numbers are represented by light intensities which are nonnegative quantities. The prior art mechanizations are, for the most part, limited to the handling of real numbers.

Accordingly, it is an object of the present invention to provide ne and improved optical data processing systems capable of handling both positive and negative numbers.

It is another object of the present invention to provide optical data processing systems capable of handling both real and complex numbers.

It is a further object of the present invention to provide optical data processing systems capable of real time processing of synthetic aperture radar data.

SUMMARY OF THE INVENTION

The foregoing and other objects of the invention are accomplished in a first embodiment by providing an optical data processor for processing both positive and negative numbers using space multiplexing. The processor includes a first modulator for spatially modulating an optical beam in response to a first signal that represents a first number and having first and second modulation areas.

A second modulator is provided for spatially modulating the optical beam exiting the first modulator in response to a second signal that represents a second number. This modulator has third and fourth modulation areas where the third and fourth modulation areas each intercept light modulated by both the first and second modulation areas.

A light detector is included having four light detection areas. The first detection area is responsive to light modulated by the first and third modulation areas. The second detection area is responsive to light modulated by the second and third modulation areas. The third detection area is responsive to light modulated by the first and fourth modulation areas, and the fourth detection area is responsive to light modulated by the second and fourth modulation areas.

Control circuitry enables the first signal to modulate the beam at the first modulation area if the first number is positive and to modulate the beam at the second modulation area if the first number is negative, where the degree of modulation at the first and second modulation areas is proportional to the magnitude of the first number. The control circuitry also enables the second signal to modulate the beam at the third modulation area if the second number is positive and to modulate the beam at the fourth modulation area if the second number is negative, where the degree of modulation at the third and fourth modulation areas is proportional to the magnitude of the second number.

A second embodiment of the invention includes an optical processor for multiplying both positive and negative numbers using both space and time multiplexing, and eliminates most of the nonlinearities associated with the previous embodiment. This processor includes a first modulator for spatially modulating an optical beam in response to a first signal that represents a first number and a first position bias signal and has first and second modulation areas.

A second modulator spatially modulates the optical beam in response to a signal that represents a second number and a second bias signal and is positioned so that the beam is modulated both by the first and second modulators. This modulator has a third modulation area which modulates the same portion of the beam modulated by both the first and second modulation areas. A light detector is included having two light detection areas. The first detection area provides a first detector signal in response to light modulated by the first and third modulation areas, and the second detection area provides a second detector signal in response to light modulated by the second and third modulation areas.

A first control signal is generated which is the sum of the first signal and the first bias signal, a second control signal is generated which is the difference between the first bias signal and the first signal, a third control signal is generated which is the sum of the second signal and the second bias signal, and a fourth control signal is generated which is the difference between the second bias signal and the second signal.

Control circuitry controls the optical processing of the first and second numbers in a first interval of time by enabling the first control signal to modulate the beam at the first modulation area, enabling the second control signal to modulate the beam at the second modulation area, and enabling the third control signal to modulate the beam at the third modulation area.

The optical processing of the first and second signals that represent the first and second numbers in a second interval of time is controlled by enabling the second control signal to modulate the beam at the first modulation area, enabling the first control signal to modulate the beam at the second modulation area, and enabling the fourth control signal to modulate the beam at the third modulation area. The degree of modulation of the modulation areas is proportional to the magnitude of the control signal applied to the respective area.

An accumulator, preferably incorporated as part of the light detector, sums the first detector signal over the first and second intervals of time and provides this sum to the positive input terminal of a differential amplifier. The accumulator also sums the second detector signal over the first and second intervals of time and provides this sum to the negative input terminal of the differential amplifier. The output signal from the amplifier is proportional to the desired product of the first and second numbers.

A third embodiment of the invention includes an optical processor for processing complex numbers using space multiplexing. A first complex number is decomposed into three real positive-valued signal components, $\alpha_1$, $\beta_1$, $\gamma_1$, respectively, and a second complex number is decomposed into three real positive-valued signal components, $\alpha_2$, $\beta_2$, $\gamma_2$, respectively.

A first modulator is provided for spatially modulating an optical beam in response to the signal components $\alpha_1$, $\beta_1$, $\gamma_1$ and includes first, second and third modulation areas. A second modulator spatially modulates the optical beam exiting the first modulator in response to the signal components $\alpha_2$, $\beta_2$, $\gamma_2$ and includes fourth, fifth and sixth modulation areas.

A light detector is provided having nine light detection areas. The first detection area is responsive to light modulated by the first and fourth modulation areas, the second detection area is responsive to light modulated by the first and fifth modulation areas, the third detection area is responsive to light modulated by the first and sixth modulation areas, the fourth detection area is responsive to light modulated by the second and fourth modulation areas, the fifth detection area is responsive to light modulated by the second and fifth modulation areas, the sixth detection area is responsive to light modulated by the second and sixth modulation areas, the seventh detection area is responsive to light modulated by the third and fourth modulation areas, the eighth detection area is responsive to light modulated by the third and fifth modulation areas, and the ninth detection area is responsive to light modulated by the third and sixth modulation areas. As will be explained below, the responses of certain prescribed detection areas must be summed to obtain the signal components $\alpha$, $\beta$, $\gamma$ of the product.

Control circuitry enables the signal components $\alpha_1$, $\beta_1$, $\gamma_1$ to modulate the beam at the first, second and third modulation areas, respectively, and enables the signal components $\alpha_2$, $\beta_2$, $\gamma_2$ to modulate the beam at the fourth, fifth and sixth modulation areas, respectively. The degree of modulation at each modulation area is proportional to the magnitude of the respective component.

A fourth embodiment of the invention includes an optical processor for processing complex numbers using both space and time multiplexing. As in the previous embodiment, a first complex number is decomposed into three real positive-valued signal vectors $\alpha_1$, $\beta_1$, $\gamma_1$, respectively, and a second complex number is decomposed into three real positive-valued signal vectors $\alpha_2$, $\beta_2$, $\gamma_2$, respectively.

A first modulator spatially modulates an optical beam in response to the signal vectors $\alpha_1$, $\beta_1$, $\gamma_1$, and has first, second and third modulation areas. A second modulator spatially modulates an optical beam in response to the signal vectors $\alpha_2$, $\beta_2$, $\gamma_2$, and has a fourth modulation area.

A light detector is provided having three light detection areas. The first detection area is responsive to light modulated by the first and fourth modulation areas, the second light detection area is responsive to light modulated by the second and fourth modulation areas, and the third detection area is responsive to light modulated by the third and fourth modulation areas.

Control circuitry controls the optical processing of the complex numbers in a first interval of time by enabling the signal vectors $\alpha_1$, $\beta_1$, and $\gamma_1$ to modulate the beam at the first, second and third modulation areas, respectively, and to enable the signal vector $\alpha_2$ to modulate the beam at the fourth modulation area. The circuitry controls the optical processing of the complex numbers in a second interval of time by enabling the signal vectors $\alpha_1$, $\beta_1$, $\gamma_1$ to modulate the beam at the second, third and first modulation areas, respectively, and to enable the signal vector $\beta_2$ to modulate the fourth modulation areas. The circuitry also controls the optical processing of the complex numbers in a third interval of time by enabling the signal vectors $\alpha_1$, $\beta_1$, and $\gamma_1$ to modulate the beam at the third, first and second modulation areas, respectively, and to enable the signal vector $\gamma_2$ to modulation of the first through fourth modulation areas is proportional to the magnitude of the respective vector modulating that area.

A fifth embodiment of the invention includes an optical processor for multiplying complex numbers using both space and time multiplexing in conjunction with bias signals. Unlike the previous embodiment, the complex numbers need not be decomposed into signal components $\alpha$, $\beta$, $\gamma$. Further, this embodiment eliminates most of the nonlinearities associated with the previous embodiment.

A first modulator spatially modulates an optical beam in response to the real and imaginary signal parts of a first complex number and a first bias signal and has first and second modulation areas. A second modulator spatially modulates an optical beam in response to the real and imaginary signal parts of a second complex number and a second bias signal and has third and fourth modulation areas.

A light detector is provided having four light detection areas. The first detection area provides a first detector signal in response to light modulated by the first and third modulation areas, the second light detection area provides a second detector signal in response to light modulated by the first and fourth modulation areas, the third detection area provides a third detector signal in response to light modulated by the second and third modulation areas, and the fourth detection area provides a fourth detector signal in response to light modulated by the second and fourth modulation areas.

A first control signal is generated which is the sum of the real signal part of the first complex number and the first bias signal. A second control signal is generated which is the difference between the first bias signal and the real signal part of the first complex number. A third control signal is generated which is the sum of the imaginary signal part of the first complex number and the first bias signal. A fourth control signal is generated which is the difference between the first bias signal and the imaginary signal part of the first complex number.

A firth control signal is generated which is the sum of the real signal part of the second complex number and the second bias signal. A sixth control signal is generated which is the difference between the second bias signal and the real signal part of the second complex number. A seventh control signal is generated which is the sum of the imaginary signal part of the second complex number and the second bias signal, and an eighth control signal is generated which is the difference between the second bias signal and the imaginary signal part of the second complex number.

Control circuitry controls the optical processing of the complex numbers in a first interval of time by enabling the first, second, eighth and seventh control signals to modulate the beam at the first, second, third and fourth moudlation areas, respectively. The circuitry controls the optical processing of the complex numbers in a second interval of time by enabling the second, first, seventh and eighth control signals to modulate the beam at the first, second, third and fourth modulation areas, respectively. The circuitry controls the optical processing of the complex numbers in a third interval of time by enabling the third, fourth, sixth and fifth control signals to modulate the beam at the first, second, third and fourth modulation areas, respectively. Finally, the circuitry controls the optical processing of the complex numbers in a fourth interval of time by enabling the fourth, third, fifth and sixth control signals to modulate the beam at the first, second, third and fourth modulation areas, respectively. The degree of modulation of the modulation areas is proportional to the magnitude of the control signal applied to the respective area.

An accumulator, preferably incorporated as part of the light detector, sums over the four intervals of time and for each of the four detection areas, the detector signals generated over the four intervals at each of these areas. Analog data shifting circuitry, also preferably incorporated as part of the light detector, provides during a fifth interval of time, the summed signals from the first detector area to the positive input terminal of a differential amplifier, and the summed signal from the third detection area to the negative input terminal of the amplifier. The output signal from the amplifier during this fifth interval of time is proportional to the real part of the product of the first and second complex numbers.

During a sixth interval of time the summed signals from the second and fourth detection areas are provided, respectively, to the positive and negative input terminals of the differential amplifier. During the sixth interval of time, the output signal from the amplifier is proportional to the imaginary part of the product of the first and second complex numbers.

A sixth embodiment of the invention is particularly suitable for real time processing of synthetic aperture radar data. The sixth embodiment includes an optical processor for real-time optical processing of synthetic aperture radar (SAR) return signals, comprising:

means for sourcing noncoherent light to provide a spatially uniform input light beam;

means coupled to said light sourcing means for time modulating the intensity of said light beam in accordance with data representative of said SAR return signals;

first spatial light modulating means for spatially modulating said input light beam along a range axis in response to range correlation reference signals;

second spatial light modulating means for spatially modulating the light beam exiting said first spatial modulating means along an azimuth axis in response to azimuth correlation reference signals, said first and second light modulators oriented such that said range and azimuth axes are crossed;

a light detector array comprising a matrix of light detectors arranged in optical alignment with the light beam exiting said second spatial light modulating means, each of said detectors for providing a detector signal representative of the light intensity incident thereon, said array adapted to perform a shift and integrate function along the detectors of each row along said azimuth axis in correspondence with the data modulating said light source means and to provide a series of output data values representative of image data in the range and azimuth dimensions.

A seventh embodiment of the invention includes an optical processor for optically processing synthetic aperture radar (SAR) return signals to provide image signals correlated in range and azimuth dimensions, comprising:

means for sequentially providing a plurality $N_D$ of return samples representing the SAR return signals from a transmitted SAR pulse;

means for sourcing light to provide a spatially uniform light beam;

means coupled to said light sourcing means and said sample providing means for modulating the intensity of said light beam during a first time interval by a sequence of $N_D$ modulating signals representative of said plurality of return samples;

first spatial light modulating means for spatially modulating said light beam along a range dimension axis in response to range correlation reference signals;

second spatial light modulating means for spatially modulating the light beam along an azimuth dimension axis in response to azimuth correlation reference signals, said first and second spatial light modulating means oriented such that said range and azimuth axes are crossed;

a light detector array comprising a matrix of light detectors arranged in M rows and N columns of light detectors in optical alignment with said light beam exiting said first and second light modulating means, said light detectors provided at an array density equivalent to the effective resolution of the optical processor, each of said light detectors providing a detector signal responsive to light modulated by said first and second light modulating means;

accumulator means operatively coupled to said respective light detectors for summing the respective detector signals over said first time interval to provide accumulated detector signals representative of partial sums of the respective products of said modulating signals, said range correlation reference signals and said azimuth correlation reference signals over said first time interval;

means for shifting said respective accumulated detector signals along the azimuth axis to the next adjacent light detector in response to an array clock signal at a rate at least equal to the SAR pulse repetition rate; and means for providing the respective accumulated detector signals of the Nth column of light detectors as SAR image data signals representative of the correlated SAR image at predetermined range and azimuth cells.

An eighth embodiment of the invention includes an optical processor for optically processing synthetic aperture radar (SAR) return signals from SAR pulses transmitted at a predetermined pulse repetition frequency comprising:

means for providing $N_D$ analog samples representing the SAR return signals;

means for sampling the SAR return signals to provide $N_D$ analog data samples representing the SAR return for each transmitted SAR pulse, said sampling means operating at a first clock rate selected to capture the desired spectral content of said SAR return signals;

means for sourcing light to provide a spatially uniform light beam;

means coupled to said light sourcing means for modulating the intensity of said light beam at a second clock rate during a predetermined time interval no greater in duration than the SAR interpulse-period, said modulating means for sequentially modulating the intensity of said light beam by the respective magnitudes of said respective $N_D$ samples;

a first planar array of M one-dimensional light modulators defining aligned strip regions in said layer whose respective transmissivities vary as a function of the magnitude of the respective range correlation reference values for M range bins;

means for sequentially modulating at said second clock rate said M one-dimensional light modulators with a matrix G of range correlation reference values arranged in M rows and $N_D$ columns;

a second planar array of N one-dimensional light modulators defining aligned strip regions in said second layer whose respective transmissivities vary as a function of the magnitude of the respective azimuth correlation reference values for N azimuth bins;

means for sequentially modulating at said second clock rate said N one-dimensional light modulators with a matrix H of azimuth correlating reference values arranged in N rows and $N_D$ columns; and an accumulator array comprising:

(i) a matrix of light detector cells arranged in M rows with N columns in optical alignment with said light beam exiting said first and second arrays of one-dimensional light modulators, each of said light detector cells providing a detector signal responsive to light modulated by said first and second arrays;

(ii) accumulator means for summing the respective detector signals over said first time interval to provide accumulated detector signals representative of the sums of the triple product of said $N_D$ sample values and the respective G and H reference correlation matrices:

(iii) means for shifting said accumulated detector signals at a third clock rate at least as fast as the SAR pulse repetition frequency row-wise along said azimuth axis to the next adjacent detector cell to be summed by said accumulator means with the respective accumulated detector signal for the next successive first time interval wherein said $N_D$ samples represent the radar returns from the next transmitted pulse; and (iv) means for shifting out the respective accumulated detector signals for the Nth column of detector cells, said detector signals representing SAR image data for a particular azimuth bin and M respective range bin cells correlated over N transmitted pulses.

BRIEF DESCRIPTION OF THE DRAWINGS

FIG. 2 is a side view of an optical data processor constructed in accordance with the present invention;

FIG. 3 is a perspective view of an electro-optical spatial light modulator for use in the present invention;

FIG. 4 is a perspective view of another electrooptical spatial light modulator for use in the present invention;

Figure 9:
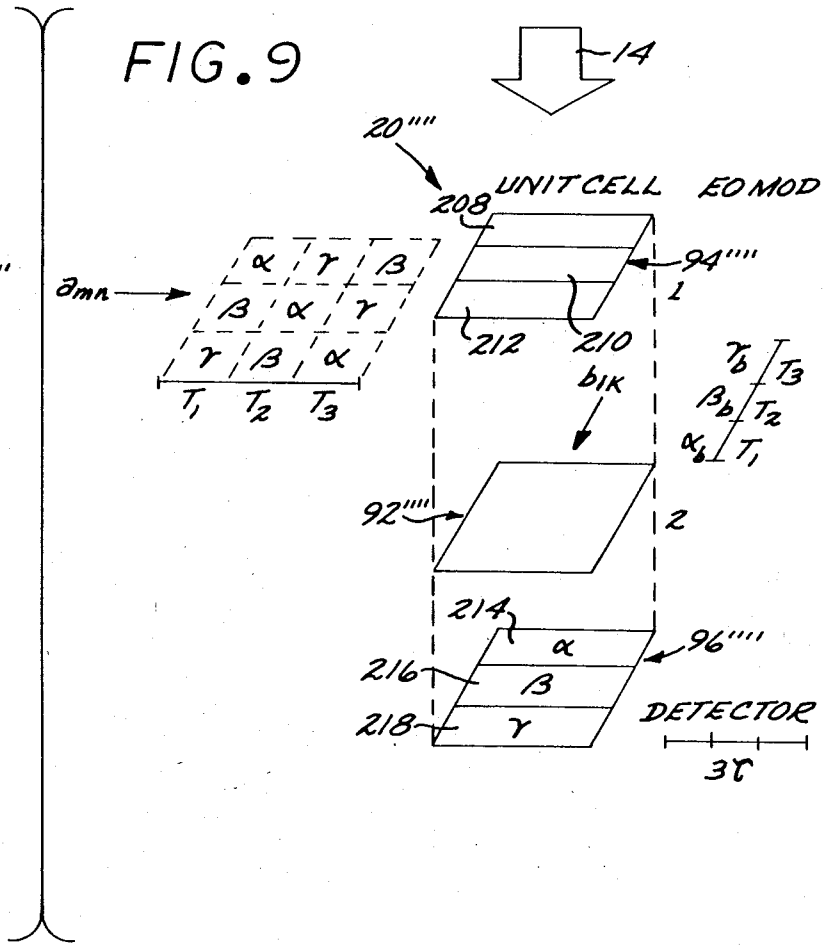
Figure 8:
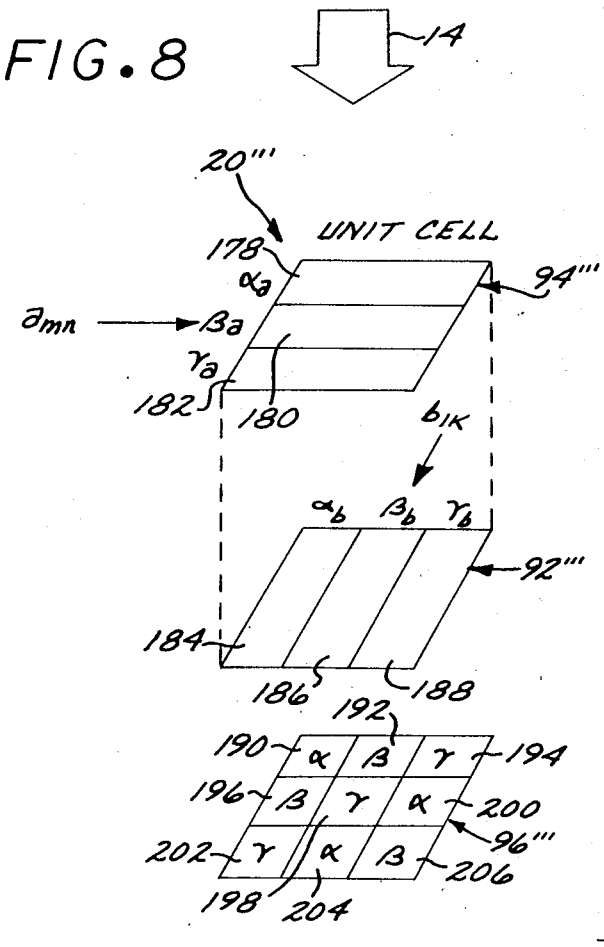
Figure 10:
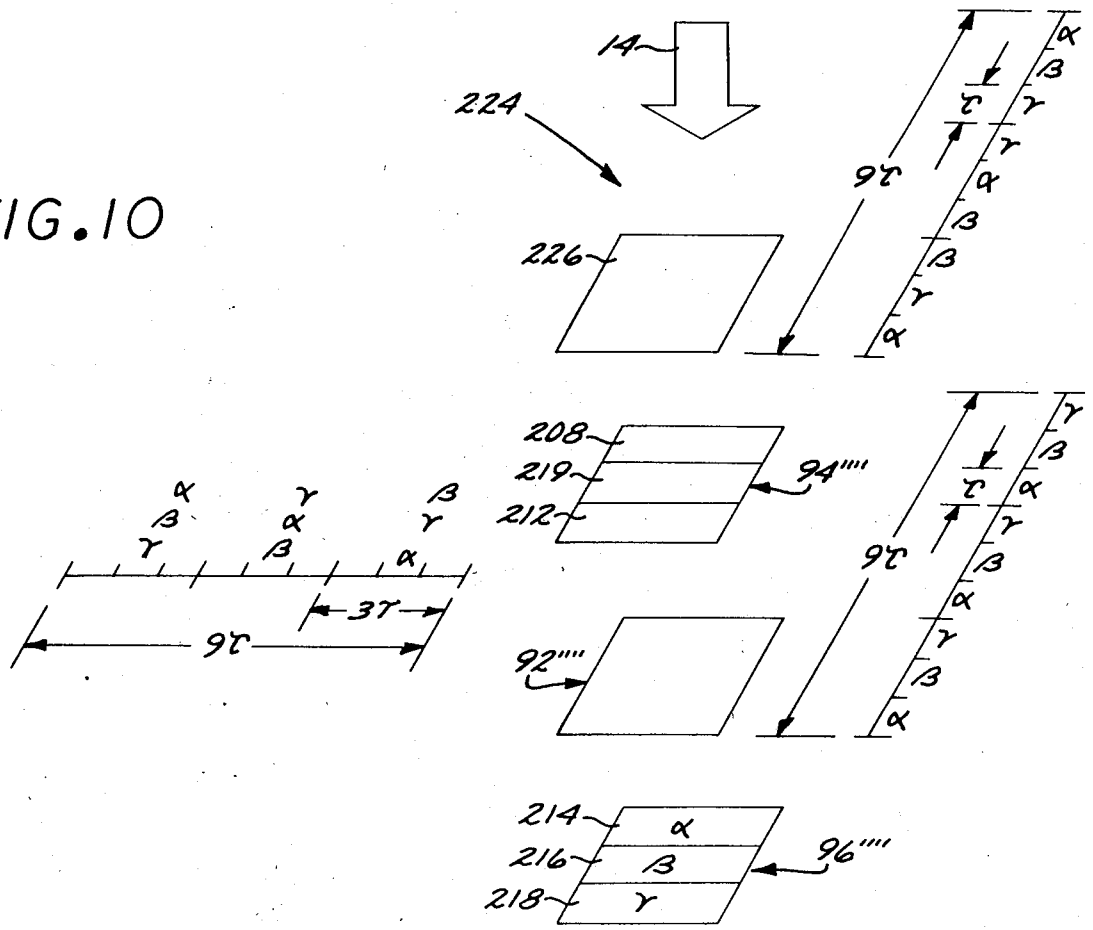
Figure 11B:
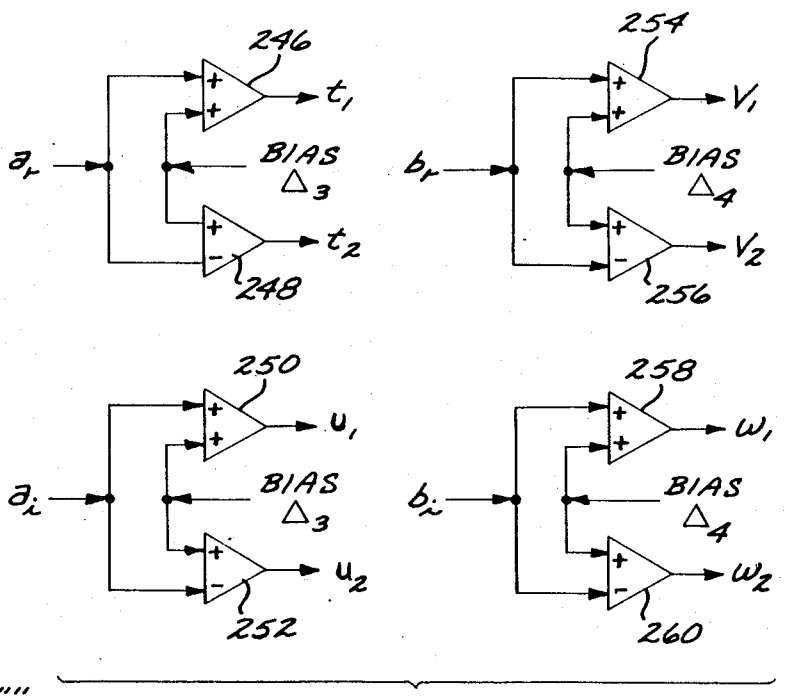
Figure 11A:
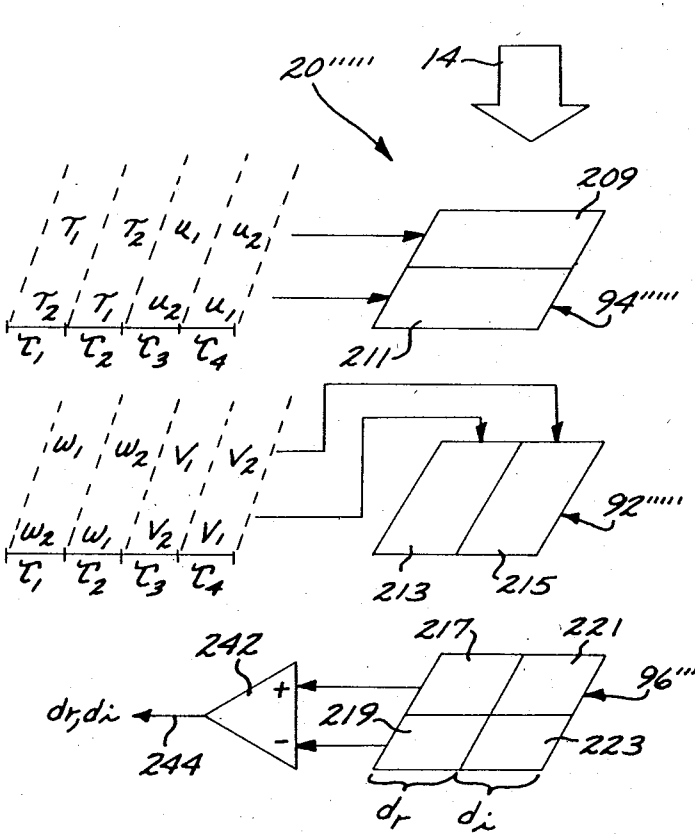
Figure 14:
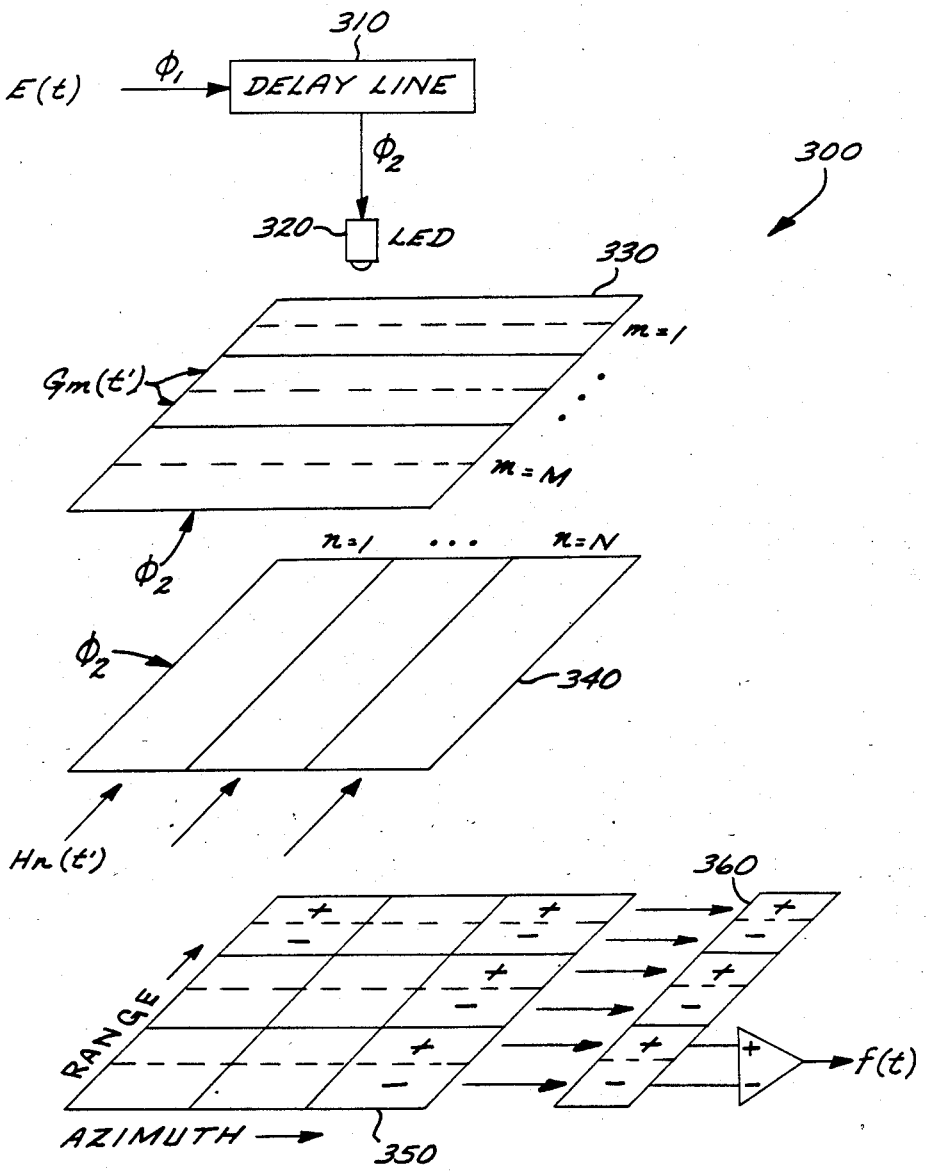
Figure 15:
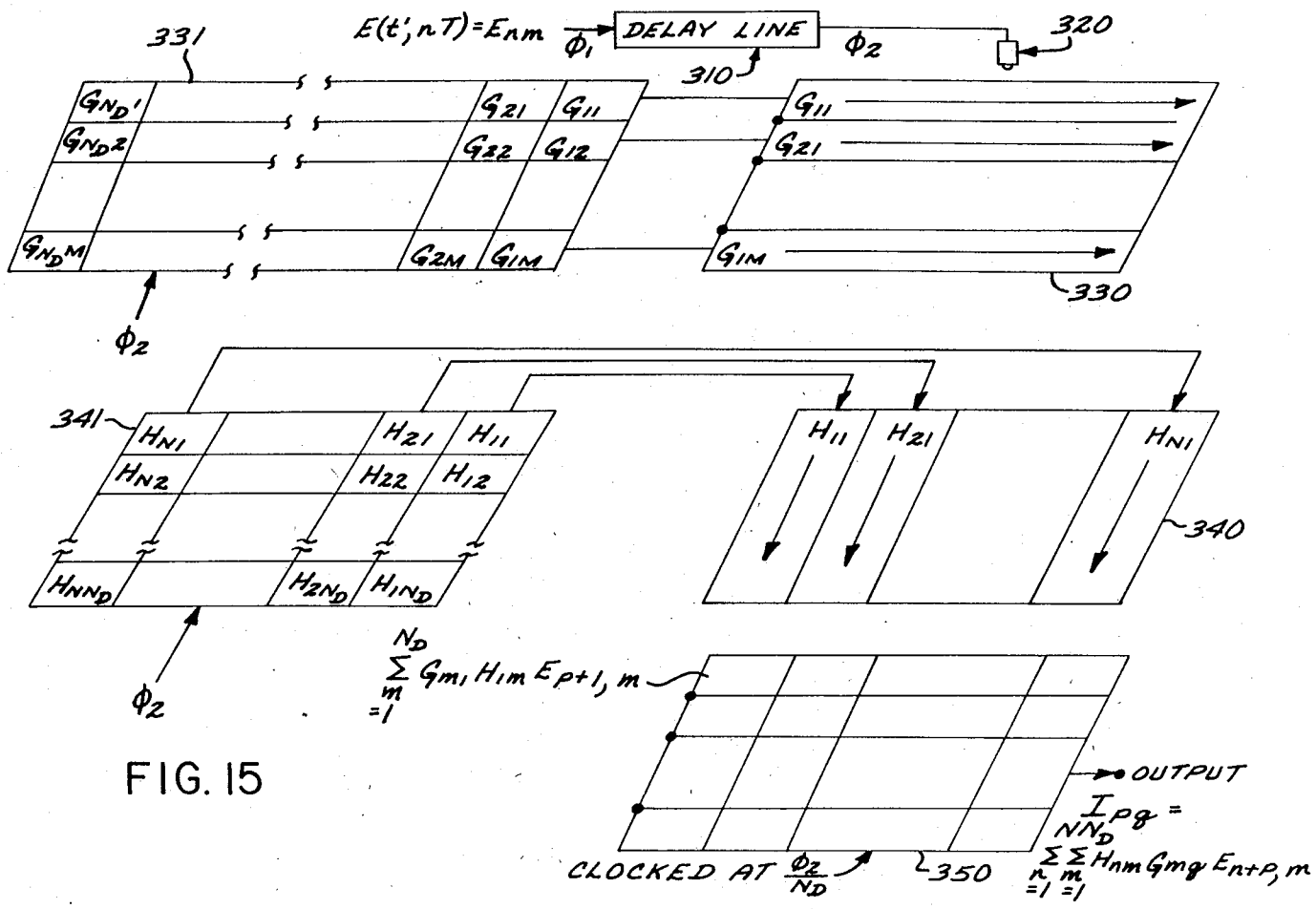
Figure 16:
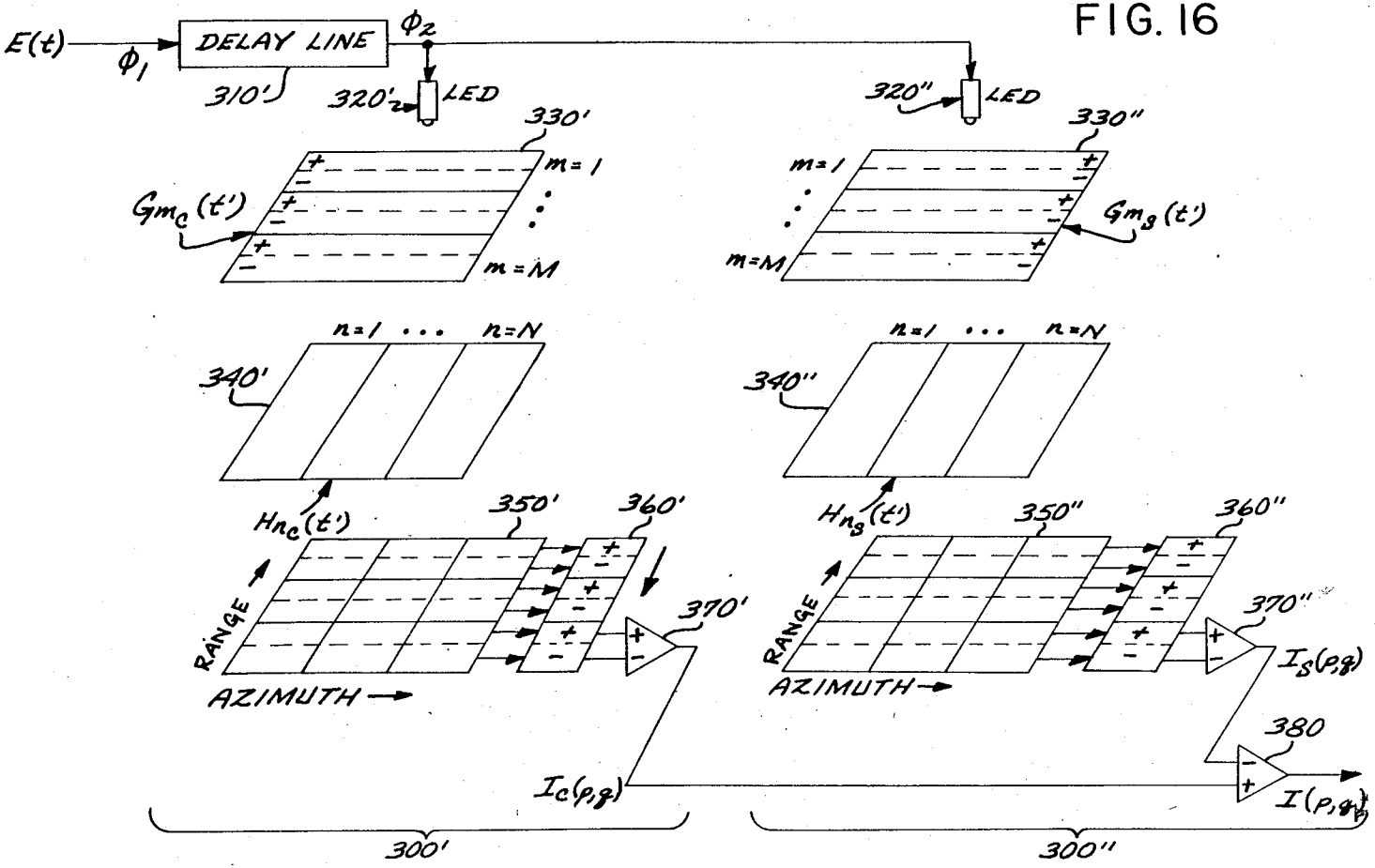

FIG. *7a* is an exploded perspective view of a unit cell portion of an optical processor constructed in accordance with a second embodiment of the invention for processing bipolar data using space and time multiplexing;

FIG. *7b* shows signal processing circuitry that may be employed with the second embodiment of the invention;

FIG. 8 is an exploded perspective view of a unit cell portion of an optical processor constructed in accordance with a third embodiment of the invention of processing complex data using space multiplexing;

FIG. 9 is an exploded view of a unit cell portion of an optical processor constructed in accordance with a fourth embodiment of the invention for processing complex data using space and time multiplexing;

FIG. 10 is an exploded view of a unit cell portion of an optical processor similar to that shown in FIG. 9 but employing an additional electro-optical spatial light modulator;

FIG. 11*b* is an exploded view of a unit cell portion of an optical processor constructed in accordance with a fourth embodiment of the invention for processing complex data using space and time multiplexing in conjunction with bias signals;

FIG. 11*a* shows signal processing circuitry that may be employed with the fourth embodiment of the invention;

FIG. 12 is a diagrammatic depiction of an SAR moving platform in relation to a point target, illustrating the SAR geometry;

FIG. 13 is a graph of the SAR radar return signal as a function of two time variables;

FIG. 14 is a block diagram of a preferred embodiment of an optical processor for SAR data in accordance with the invention;

FIG. 15 is a diagrammatic depiction of the spatial modulators and detector array comprising the processor of FIG. 14, illustrative of the outer product multiplication function performed by the processor; and FIG. 16 is a block diagram of an alternate embodiment of an optical processor for SAR data in accordance with the invention.

DESCRIPTION OF THE PREFERRED EMBODIMENTS

Figure 1:
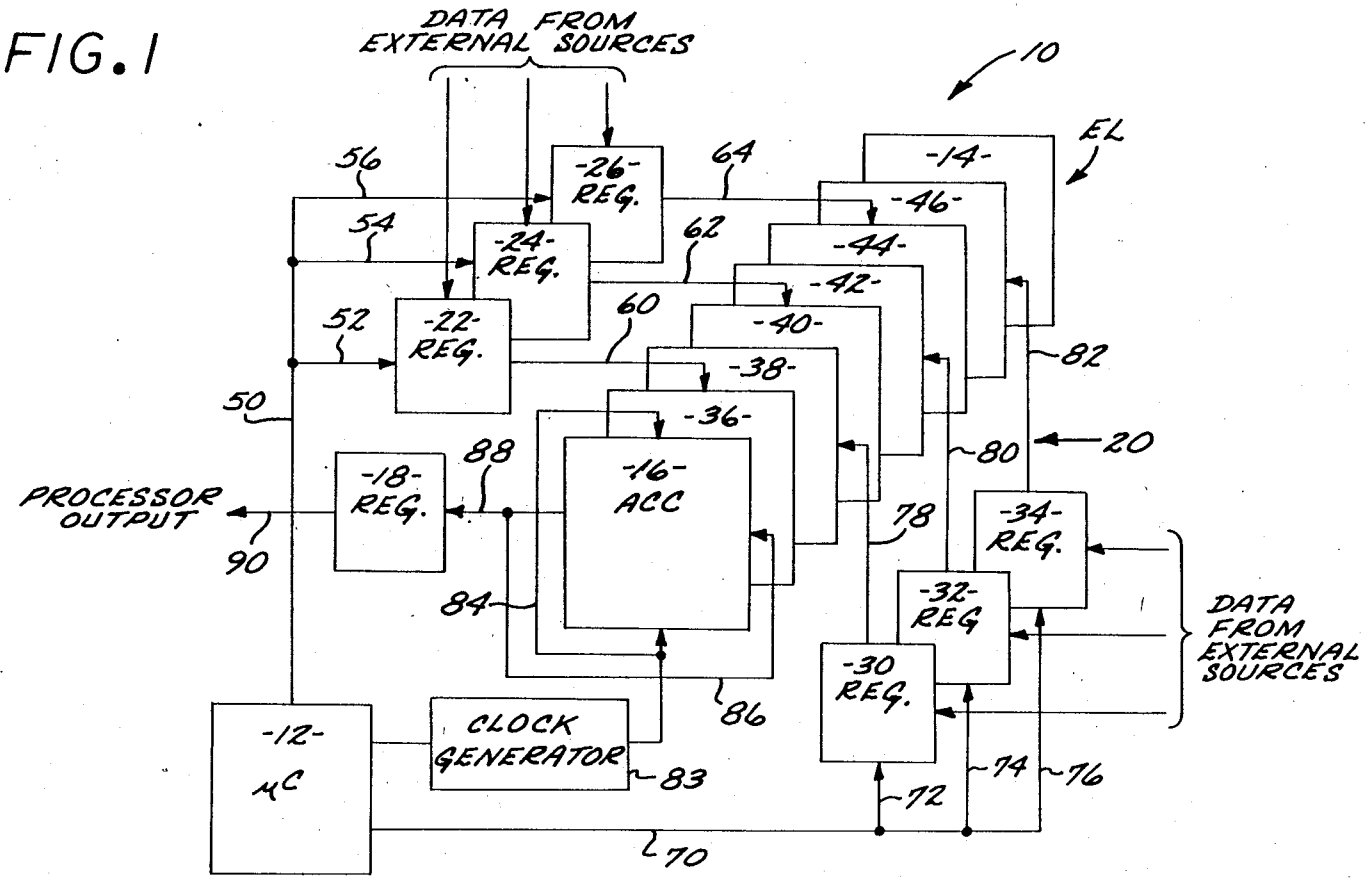
FIG. 1 is a block diagram of an optical data processing system in accordance with the present invention.

The preferred system embodiment for use with the present invention, generally indicated by the reference numeral 10, is shown in FIG. 1. In particular, the preferred multistage optical data processor (ODP), generally indicated by the reference numeral 20, is operatively supported by a microcontroller 12 and interface registers 18, 22, 24, 26, 30, 32 and 34. The principle operative components of the ODP are shown in FIG. 1 as including a flat panel or LED light source 14, matrix array accumulator (also referred to as a detector array) 16 and a plurality of spatial light modulators (SLMs) 36, 38, 40, 42, 44 and 46. Preferably, the light source 14, accumulator 16 and the SLMs 36, 38, 40, 42, 44, 46 are provided in closely adjacent parallel planes with respect to one another such that a relatively uniform beam sourced by the light source 14 travels through each of the spatial light modulators in succession and is ultimately received by the accumulator 16.

The light beam is effectively used as a data transport mechanism acquiring data provided by each of the spatial light modulators that is subsequently delivered to the accumulator 16. The operation of each of the spatial light modulators can be explained in terms of their spatial transmissivity variation with respect to corresponding spatially distributed activating voltage potentials. To a first approximation at least, the light amplitude transmissivity of a spatial light modulator is directly proportional to the applied voltage potential. Thus, the combined transmissivity (T0) of two serially coupled spatial light modulators is proportional to the product of the respective transmissivities T1, T2 of the spatial light modulators. The combined transmissivity T0 can thus be written as:

$$T0 = T1 \times T2 \quad (1)$$

$$T0 = C \times D \times V1 \times V2 \quad (2)$$

V1 and V2 are the respectively applied voltage potentials, and C and D are the transmissivity to applied voltage coefficients for the respective spatial light modulators. Where an extended series of spatial light modulators are serially coupled, in accordance with the present invention, the combined transmissivity T0 of the multistage spatial light modulator stack is proportional to the product of the respective transmissivities of the individual spatial light modulators. A light beam sourced by the flat panel 14 can thus be directed to acquire spatially distributed data corresponding to the spatially distributed relative transmissivities of each of the spatial light modulators 36, 38, 40, 42, 44 and 46.

In accordance with the preferred embodiment of the optical processor used in accordance with the present invention, spatially relatable data is provided to the spatial light modulators 36, 38, 40, 42, 44 and 46 via the interface registers 22, 24, 26, 30, 32 and 34. These registers preferably operate as high speed digital data storage registers, buffers and digital-to-analog data converters. As will be discussed in greater detail below, the stack of spatial light modulators preferably includes a plurality of one-dimensional spatial light modulators. As shown in FIG. 1, one-dimensional spatial light modulators 36, 38, 40, 42, 44 and 46 are coupled to respective registers 22, 30, 24, 32 and 26 via interface data lines 60, 78, 62, 80, 64 and 82.

The interface registers 22, 24, 26, 30, 32 and 34 in turn preferably receive data in a parallel form provided by external sources. The microcontroller 12 via the processor control buses 50, 70 provides the control signals. While the processor control buses 50, 70 are shown as separate and respectively connected to the registers by the register control lines 52, 54, 56, 72, 74 and 76, the interface registers may alternately be coupled via control multiplexers to a single, common control bus driven by the microcontroller 12. In either case, however, it is essential only that the microcontroller 12 possess sufficient control over the registers 22, 24, 26, 30, 32 and 34 to selectively provide its predetermined data thereto.

The optical data processor system 10 is completed with the provision of the output register 18 coupled between the accumulator 16 and the processor output. The accumulator 16 itself is a matrix array of photosensitive devices capable of converting incident light intensity into a corresponding voltage potential representative of the data beam at an array resolution at least matching that of the spatial light modulators 36, 38, 40, 42, 44 and 46. As will be described in greater detail below, the accumulator 16 accumulates light beam data that can then be shifted by means of a clock signal supplied by a clock generator 83 to the data output register 18 via the output interface bus 88. The accumulator 16 also includes circular shift bus 86 and lateral shift bus 84 to permit a wide variety of shift and sum operations to be performed within the accumulator 16 during the operation of the optical data processor 20.

The data output register 18 is preferably a high speed analog-to-digital converter, shift register and buffer that channels the shifted output data from the accumulator 16 to the processor output via the processor data output bus 80.

As should be well apparent from the foregoing, the microcontroller 12 possesses full control over the optical data processor 20. Any desired data can be provided to any specific combination of spatial light modulators to implement a desired data processing algorithm. Of particular facility is that only those spatial light modulators required for the performance of any particular optical data processing algorithm need be actively utilized in the optical data processor 20 in accordance with the present invention. Spatial light modulators within the optical data processor 20 may be provided with appropriate data via their respective data registers to uniformly maintain the spatial light modulators at their maximum transmissivity. Consequently, selected spatial light modulators may be effectively removed from the optical data processor by their appropriate data programming. Thus, the optical data processing system 10 provides an extremely flexible environment for the performance of optical data processing computations.

The structure of an optical data processor 20 fabricated in accordance with the preferred optical processor embodiment of the present invention is shown in FIG. 2. The embodiment shown is exemplary as including substantially all of the principle components that may be incorporated into any preferred embodiment of the optical processor.

The components of the optical data processor include the light source 14, SLM stages 36 through 46 and detector array 16. The flat panel light source 14 is preferably an electroluminescent display panel or, alternately, a gas plasma display panel or LED or LED array or laser diode or laser diode array. A diffuser (not shown) may be utilized to grade the light produced by the flat display panel into a spatially uniform optical beam.

The bulk of the optical data processor 20 is formed by a serial stack of SLM stages, of which SLM stage 46 is representative. Preferably, the SLM is a rigid structure requiring no additional support. In such embodiments, the SLMs may be placed immediately adjacent one another, separated only by a thin insulating optically transparent layer, yielding an optimally compact multistage stack of spatial light modulators. In embodiments where the operation of the spatial light modulator is accomplished through the polarization modulation of the light beam, polarizers 64 are preferably interposed between the SLMs. The polarizer 64 further permits the utilization of an unpolarized optical data beam source 14 in local polarization vector data representation embodiments of the present invention. If the principle of operation of the spatial light modulators is light absorption (instead of polarization rotation), then there is no need for the polarizers.

The accumulator 16 is preferably a solid state matrix array of optical detectors. In particular, the optical detector array is preferably a shift register array of conventional charge couple devices (CCDs) provided at an array density equivalent to the effective resolution of the optical data processor 20. The use of a CCD array is preferred both for its charge accumulation, i.e., data summing, capability as well as for the ease of fabricating CCD shift register circuitry that can be directly controlled by the micro-controller 12. Further, the use of the CCD array permits substantial flexibility in the operation of the accumulator 16 by permitting data shifted out of the accumulator 16 and onto the data return bus 88 to be cycled back into the accumulator 16 via the circular shift data bus 86. Additionally, the accumulator 16 possesses the desirable flexibility through the use of adjacent register propagation path interconnections to permit lateral cycling of the data contained therein via the lateral shift data bus 84 as indicated in FIG. 1. Consequently, the accumulator 16 can be effectively utilized in the execution of quite complex optical data processing algorithms involving shift and sum operations under the direct control of the micro-controller 12.

Two preferred embodiments of one-dimensional spatial light modulators are shown in FIGS. 3 and 4, respectively. The spatial light modulator 130 shown in FIG. 3 includes an electro-optic element 132 preferably having two major parallel opposing surfaces upon which stripe electrodes 136 and potential reference plane 140 are provided, respectively. The electro-optic element 132 may be a transmission mode liquid crystal light valve though preferably it is a solid state electrooptic material, such as $KD_2PO_4$ or $BaTiO_3$. This latter material polarization modulates light locally in proportion to the longitudinal and transverse voltage potential applied across the portion of the material that the light passes through. This material characteristically possesses sufficient structural strength to be adequately self-supporting for purposes of the present invention when utilized as electro-optic elements 132 and may be provided at a thickness of approximately 5 to 10 mils for a major surface area of approximately one square inch.

As the active regions of the electro-optical element 132 necessarily lay between each of the stripe electrodes 136 and the reference plane electrode 140, the electrodes 136, 140 are preferably of a high conductivity transparent material such as indium tin oxide. Contact to the electrodes 136, 140 is preferably accomplished through the use of separate electrode leads 4, 138, respectively, that are attached using conventional wire bonding or solder bump interconnect technology.

FIG. 4 illustrates an alternate one-dimensional spatial light modulator. This spatial light modulator differs from that of FIG. 3 by the relative placement of the signal 156 and potential reference 158 electrodes on the two major surfaces of the electro-optic element 52. On each major surface, a reference potential electrode 158 is interposed between pairs of the signal electrodes 156 to form an interdigitated electrode structure that is essentially identical on both major surfaces of the electro-optic element 152. The active portions of the electro-optic element 152 lie between each of the signal electrodes 156 and their surface neighboring reference potential electrodes 158.

Thus, the achievable electro-optic effect is enhanced through the utilization of both surfaces of the electro-optic element 152. Further, as the active portions of the electro-optic element 152 are not shadowed by the signal electrodes 156, all of the electrodes 156, 168 may be of an opaque conductive material, such as aluminum, that may be further advantageously utilized to effectively mask the active regions of the electro-optic element 152. This is, the electrodes 156, 158 may be utilized to block the respective pixel edge portions of the data beam as they diverge while passing through the electro-optic element 152.

Similar to the spatial light modulators 130 of FIG. 3, the electro-optic element 152 may be either optic material. For reasons of faster electro-optic response time, greater structural strength, and ease of fabrication, transverse field polarization modulation electro-optic materials, such as represented by LiNb03, $LiTaO_3$, $BaTiO_3$, $Sr_xBa_{(1-x)}aNbO_3$ and PLZT are preferred.

The operation of an optical data processing system of the type described above is best understood by analyzing its operation in performing matrix multiplication. R. A. Athale and W. C. Collins, in their paper "Optical Matrix-matrix Multiplier Based on Outer Product Decomposition," Applied Optics 21,2089 (1982) have described the principle of outer product decomposition for optical matrix multiplication.

Thus the product matrix C of two matrices B and A is given by $$C=BA \tag{3}$$

where the ij-th element of C is given by the inner product between the i-th row vector of B and j-th column vector of A:

$$C_{ij} = \sum_m b_{im}a_{mj} \tag{4}$$

However, C can also be written as a sum of matrices, each of which is the outer product between a column vector of B and the corresponding row vector of A. The principle behind an outer product matrix multiplier is to sequentially provide the rows of matrix B into an SLM such as SLM 38 and the corresponding columns of matrix A into another SLM such as SLM 36 which is orthogonal to the first SLM. The transmission of the two crossed SLMs during the nth clock cycle of clock generator 83 is given by the outer product of the nth row of B and the nth column of A. The transmitted light falls on accumulator detector array 16 and is summed to form the product matrix C. The multiplication of two N×N matrices, which requires $N^3$ multiplications, is performed in N clock cycles.

Figure 5:
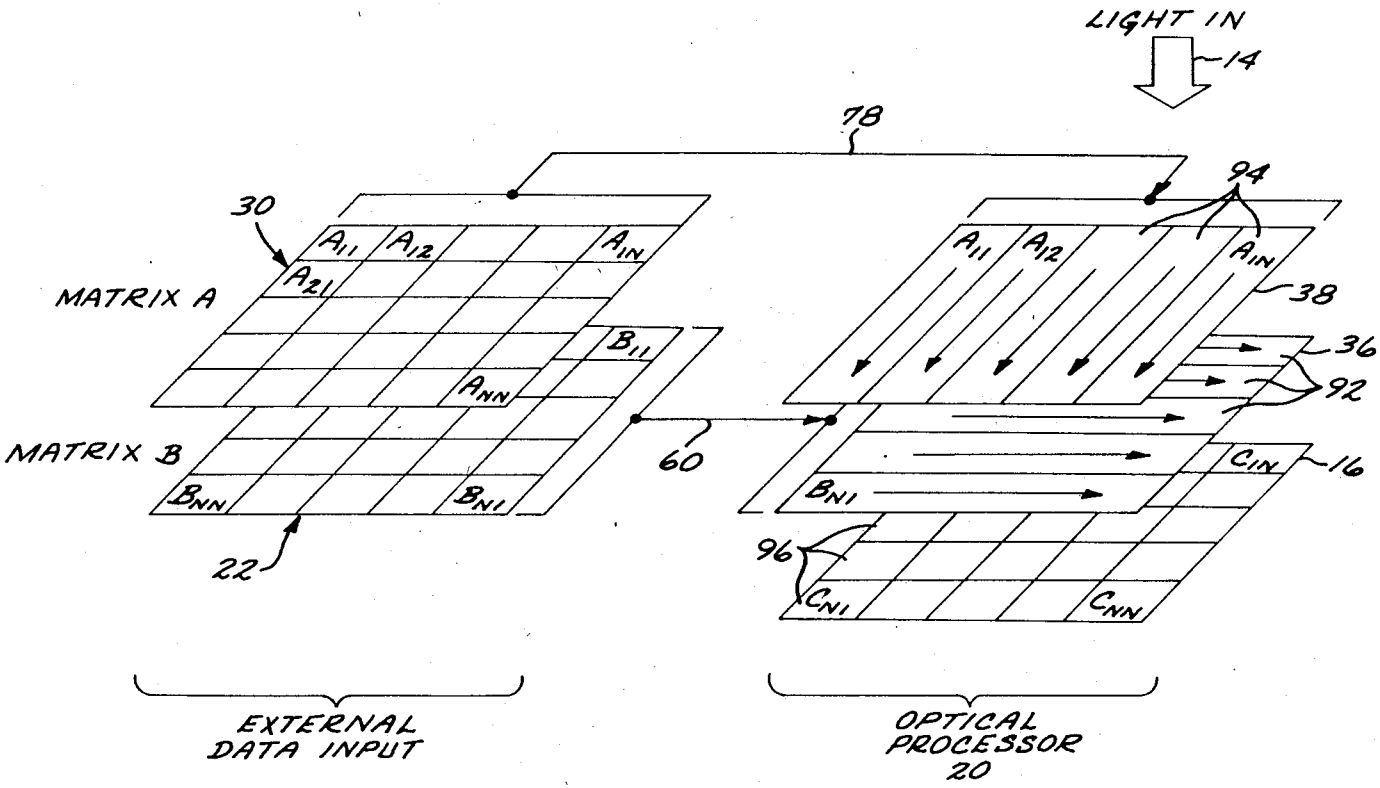
FIG. 5 PRIOR ART
FIG. 5 is an exploded perspective representation of a prior art optical data processing system for processing matrices comprising unipolar real numbers.

FIG. 5 shows the elements of the two matrices A and B as they are provided by storage registers 30 and 22 to SLMs 38 and 36, one row and column at a time, respectively. (Polarizers which are located between the SLMs have been omitted from FIG. 5 for the sake of clarity.) The electrodes on each SLM 36, 38 divide the SLM into strip shaped regions 92, 94, hereinafter referred to as unit cells. Each cell is used to process a matrix element. During the nth clock cycle, light from source 14 is modulated in one direction by the nth row of A and in the orthogonal direction by the nth column of B, forming the nth outer product matrix at the accumulator detector array 16, the sum of which is the product matrix C. Note that only two SLMs are required for the matrix multiplication operation. The array 16 is divided into cells 96, where each cell corresponds to one of the elements $c_{ij}$.

While the above described prior art optical processor works well when all elements of the matrices are positive, it is not designed to handle bipolar (negative and positive) or complex numbers. This is so because numerical values are represented by light intensities, which are non-negative quantities.

Figure 6:
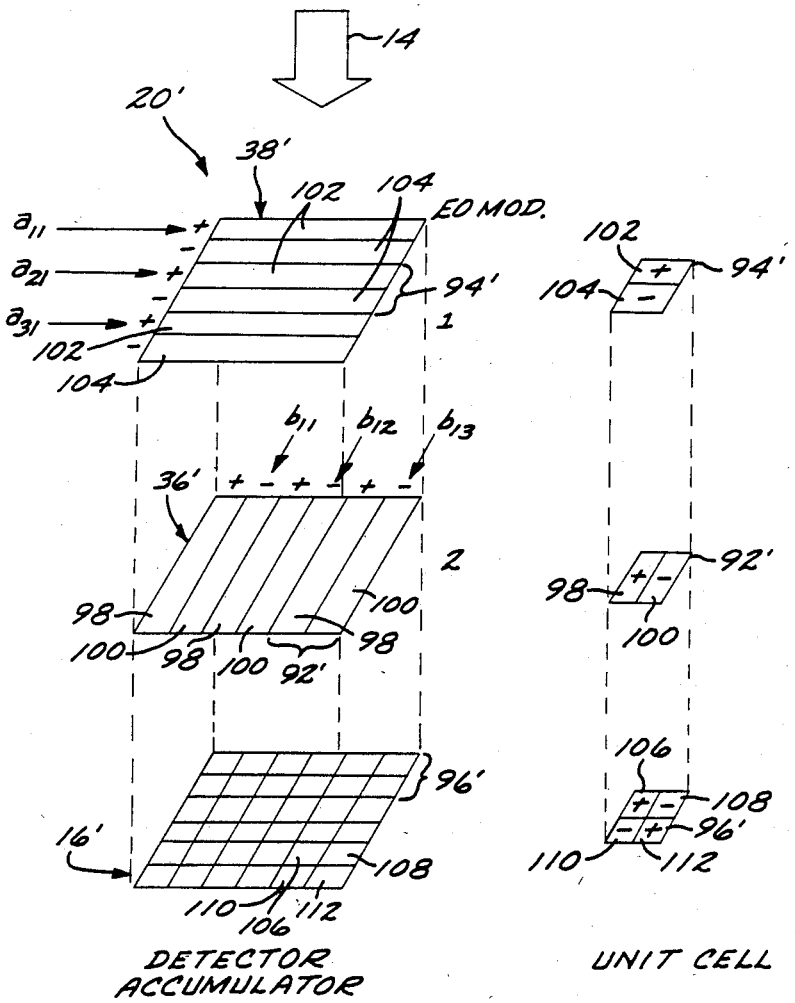
FIG. 6 is an exploded perspective view of an optical processor constructed in accordance with a first embodiment of the invention for processing bipolar data using space multiplexing.

FIG. 6 shows a first embodiment 20' of the invention which is an optical processor capable of processing bipolar numbers. To aid the reader in understanding the various embodiments of the invention, the matrix multiplication example used above, where each matrix is square and contains nine elements, will be used in describing the operation of several of the various embodiments.

The embodiment 20' includes first and second SLMs 38' and 36', respectively, a detector accumulator 16' and a light source 14 arranged in a manner similar to that previously described. The SLM 36' is divided into three stripe shaped unit cells 92', and the SLM 38' is divided into three stripe shaped unit cells 94'. The cells 92' are orthogonal to the cells 94'.

Each of the cells 92' is in turn partitioned into individually addressable light modulation areas 98 and 100, while each cell 94' is partitioned into individually addressable light modulation areas 102 and 104. The accumulator 16' is divided into nine unit cells 96'. Each cell 96' is partitioned into four light detection areas 106, 108, 110, 112. Portions of the unit cells 92', 94', 96' are shown in detail on the right in FIG. 6.

The operation of the processor 20' is as follows. Signals representing the magnitude of each of the column elements of matrix A (one column at a time) are provided to the cells 94' of SLM 38' by register 30. If the polarity of an element is positive, the signal is routed by suitable control circuitry associated with register 30 to the area 102 of the respective cell 94'. If the polarity of the element is negative, the signal representing that element is routed to the area 104 of the respective cell 94'.

In similar fashion, signals representing the magnitude of each of the row elements of matrix B (one row at a time) are provided to the cells 92' of SLM 36 by register 22. If the polarity of a particular element is positive, the signal is routed by suitable control circuitry associated with register 22 to the area 98 of the respective cell 92'. If the polarity of the element is negative, the signal representing that element is routed to the area 100 of the respective cell 92'

The four detection areas 106, 108, 110, 112 in each cell 96' of detector 16' are positioned so that each area intercepts light modulated by particular modulation areas of the SLMs 36' and 38'. Thus, area 106 detects light modulated by areas 102 and 98, area 108 detects light modulated by areas 102 and 100, area 110 detects light modulated by areas 104 and 98, and area 112 detects light modulated by areas 104 and 100.

The polarity symbols shown in the unit cell representation in FIG. 6 indicate the polarity of the matrix elements in each of the cells 94' and 92', as well as the polarity of the resultant multiplication of these elements, as detected by the various areas of unit cell 96' of detector 16'. For example, area 106 detects the product of two positive numbers, and hence is positive. Likewise, area 112 detects the product of two negative numbers, and hence is also positive. By summing the signals from detector areas 106 and 112, a signal proportional to the square of the positive product of matrix elements is obtained, and by summing the signals from detector areas 108 and 110, a signal proportional to the square of the negative product of matrix element is obtained. By taking the difference between these two signals, a resultant signal is obtained which includes the square of the product of the two bipolar numbers. Read-out of data from the detector 16' may be accomplished in 2N clock cycles for an N×N matrix array, two clock cycles being allocated to each cell. Since different areas of each cell are used to distinguish polarity, the embodiment 20' is referred to as a space-multiplexed configuration.

One of the limitations of the prior described space multiplexed embodiment is that the output signals from the detector/accumulator 16' are not directly proportional to the product of the matrix elements, but are instead proportional to the square of these products. This is so because of the square relationship between light amplitude and intensity. The modulators 38' and 36' modulate the amplitude of the light from source 14 in proportion to the magnitude of the applied signals. However, detector 16' provides signals proportional to light intensity, which is in turn proportional to the square of the light amplitude.

Accordingly, in the prior described embodiment, the detector signals must undergo further signal processing to extract the desired numerical product from the squared value, which is also biased by various arithmetic cross products. In a second embodiment of the invention 20'' shown in FIG. 7, a combination of space and time muiltiplexing is employed along with bias signals to provide a bipolar number optical processor whose output signals are directly proportional to the product of the bipolar numbers.

In the past, time multiplexed configuraiions have been suggested for optically processing bipolar numbers. For example, D. Casasent, J. Jackson, and C. Neuman propose one such configuration in their article "Frequency-multiplexed and Pipelined Iterative Optical Systolic Array Processors," Applied Optics, Vol. 22, No. 1, page 115, Jan. 1, 1983. However, these prior art processors do not directly provide output signals which are linearly proportional to the product of the bipolar numbers, as is accomplished in the following embodiment.

Referring to FIG. *7a*, there is shown unit cell portions of first and second SLMs and of a detector/accumulator accumulator array which collectively form an optical processor. It is to be understood that, as in the previous embodiment, multiple cells may be employed to process matrix arrays of complex data.

The unit cell 94'' represents one cell of an SLM such as the SLM 38 previously described. Likewise cell 92'' represents one cell of an SLM such as SLM 36, and cell 96'' represents one cell of a detector/accumulator array 16, also previously described.

The cell 94'' is partitioned into two individually addressable light modulation areas 170 and 172, while cell 92'' consists of a single addressable light modulation area. Detector cell 96'' is partitioned into two light detection areas 174 and 176.

The two detection areas 174, 176 are positioned so that each area intercepts light modulated by particular modulation areas. Thus, area 174 detects light modulated by areas 170 and 92'', and area 176 detects light modulated by areas 172 and 92''. Detector signals accumulated in area 174 are applied to a positive input terminal of a differential amplifier 230, while detector signals accumulated in area 176 are applied to a negative input terminal of the amplifier 230. As described below, the desired output signal d from the processor 20'' is provided at output terminal 232 of the amplifier 230.

Signal processing circuitry, shown in FIG. *7b*, is provided to generate signals used to control modulators 94'' and 92'' as follows. A signal representing a first bipolar number all, which may be a matrix element, is provided to the positive input terminal of a summing amplifier 234 and to the negative input terminal of a differential amplifier 236. A positive bias signal $\Delta_1$ is applied to the positive input terminals of the amplifiers 234 and 236. Appearing at the output terminal of amplifier 234 is control signal $S_1$, which is equal to $a_{11}+\Delta_1$. Appearing at the output terminal of amplifier 236 is control signal $S_2$ which is equal to $\Delta_1-a_{11}$.

A second signal representing a bipolar number $b_1$, which may be an element of a second matrix, is provided to the positive input terminal of a summing amplifier 238, and to the negative input terminal of a differential amplifier 240. A second positive bias signal $\Delta_2$ is applied to the positive input terminals of the amplifiers 238 and 240. Appearing at the output terminal of amplifier 238 is control signal $r_2$, which is equal to $\Delta_2-b_{11}$.

The operation of the processor 20'' is as follows. During a first clock interval $\tau_1$ as determined by clock generator 83, control signals are provided to cells 94'' and 92'' as follows. Control signal $S_1$ is applied to modulation area 170, control signal $S_2$ is applied to modulator area 172, and control signal $r_1$ is applied to modulation area 92''. Detection areas 174 and 176 respond to the modulated light and provide detector signals which are accumulated by the accumulator portion of the detector/accumulator 96''.

During a second clock interval $\tau_2$, control signals $S_2$, $S_1$ and $r_2$ are provided to modulation areas 170, 172, and 92'', respectively, as indicated by the time lines in FIG. 7. Detection areas 174 and 176 respond to modulated light and provide detector signals during this interval of time which are added, in each of the cells 174, 176 to the detector signals accumulated in these cells from the prior interval, $\tau_1$.

It should be noted that the amplitude of the positive bias signal $\Delta_1$ is chosen to bias the modulation areas 170, 172 at a point which will maintain these areas in their linear region of light amplitude modulation over the largest anticipated positive and negative magnitude range of the bipolar number $a_{11}$. Similarly, bias signal $\Delta_2$ is chosen to maintain the area 92'' in its linear light amplitude modulation response region over the largest anticipated positive and negative magnitude range of the bipolar number $b_{11}$. The amplitudes of the bias signals $\Delta_1$ and $\Delta_2$ may be equal to each other.

As described above, the accumulated signals from detection areas 174 and 176 are provided to the positive and negative input terminals, respectively, of differential amplifier 230. It may be shown that, at the end of the second interval of time $\tau_2$, the output signal d appearing at the output terminal 232 is proportional to $$d=16\Delta_1\Delta_2a_{11}b_{11} \tag{5}$$

Accordingly, the processor 20'' provides an output signal directly proportional to the product of bipolar numbers.

A third embodiment of the invention, shown in FIG. 8 is an optical processor using space multiplexing to process complex numbers. It is known that complex bipolar data may be decomposed into three real and positive vector components, each representing a vector oriented along the 0°, 120° and 240° polar directions. See for example J. W. Goodman and L. M. Woody, "Method for Performing Complex-valued Linear Operations on Complex-valued Data Using Incoherent Light," Applied Optics, Volume 16, p. 2611 (1977). Thus a complex value X may be decomposed into $$X=X_\alpha+X_\beta exp(i2\pi/3)+X_\gamma exp(i4\pi/3) \tag{6}$$

where $X_\alpha$, $X_\beta$ and $X_\gamma$ are real positive quantities.

FIG. 8 shows an optical processor 20'' capable of multiplying two complex numbers which have been decomposed by a suitable arithmetic processor (not shown) into their $\alpha$, $\beta$, and $\gamma$ components. The figure shows only the unit cell portions of the first and second SLMs and the detector array of the processor. It is to be understood that, as in the previous embodiments, multiple cells may be employed to process matrix arrays of complex data.

The unit cell 94''' represents one cell of an SLM such as the SLM 38 described in previous embodiments. Likewise cell 92''' represents one cell of an SLM such as SLM 36 previously described, and cell 96''' represents one cell of a detector such as 16, also previously described.

The cell 94''' is partitioned into three individually addressable light modulation areas 178, 180, 182, while cell 92''' is partitioned into three individually addressabe light modulation areas 184, 186, 188 which are orthogonal to the areas of the cell 94'''. The detector cell 96''' is divided into nine light detection areas 190, 192, 194, 196, 198, 200, 202, 204, 206.

The operation of the processor 20''' is as follows. Signals representing the magnitude of the $\alpha$, $\beta$ and $\gamma$ components of a complex number "a" are provided to the modulation areas 178, 180 and 182, respectively of cell 94'''. Signals representing the magnitude of the $\alpha$, $\beta$ and $\gamma$ components of a second complex number "b" are provided to the modulation areas 184, 186 and 188 of cell 92'''.

The nine detection areas in each cell 96''' of the detector are positioned so that each area intercepts light modulated by particular ones of the modulation areas in cells 94''' and 92'''. Thus, area 190 intercepts light modulated by areas 178 and 184, area 192 intercepts light modulated by areas 178 and 186, area 194 intercepts light modulated by areas 178 and 188, area 196 intercepts light modulated by areas 180 and 184, area 198 intercepts light modulated by areas 180 and 186, area 200 intercepts 123''' light modulated by areas 180 and 188, area 202 intercepts light modulated by areas 182 and 184, area 204 intercepts light modulated by areas 182 and 186, and area 206 intercepts light modulated by areas 182 and 188.

The $\alpha$, $\beta$ and $\gamma$ symbols shown in each of the nine detector areas in FIG. 8 indicate the cyclic association of the various component products, which can be readily derived using the definition of products in the polar representation of complex numbers. The various $\alpha$, $\gamma$ and $\gamma$ component products may be read-out from cell 96''' in three clock intervals and arithmetically combined in a well known fashion to obtain in Cartesion coordinates signals including the squares of the real and imaginary parts of the product of complex numbers "a" and "b".

A fourth embodiment of the invention 20'''' shown in FIG. 9 uses a combination of space and time multiplexing to process complex numbers, where the numbers have been decomposed into three real, positive components as described in the previous embodiment.

FIG. 9 shows the unit cell construction of the first and second SLMs and the detector array of the processor 20''''. As in the previous embodiments, multiple cells may be employed to process arrays of complex data.

The unit cell 94'''' represents one cell of an SLM such as the SLM 38 described above. Likewise the cell 92''' represents one cell of an SLM such as SLM 36, and cell 96'''' represents one cell of a detector such as 16, also previously described.

The cell 94'''' is partitioned into three individually addressable light modulation areas 208, 210, 212 which are orthogonal to the modulation area defined by cell 92''''. Detector cell 96'''' is partitioned into three light detection areas 214, 216, 218.

The operation of the processor 20'''' is as follows. During a first clock interval $\tau_1$ as determined by clock generator 83, signals representing the magnitude of the $\alpha$, $\beta$ and $\gamma$ components of a complex number "a" are provided to the modulation areas 208, 210 and 212, respectively, of cell 94''''. A signal representing the magnitude of only the o component of a second complex number "b" is provided to the modulation area 92''''.

During a second clock interval $\tau_2$, signals representing the $\gamma$, $\alpha$, and $\beta$ components of "a" are provided to the areas 208, 210, and 212, respectively, while only the $\beta$ component of "b" is provided to area 92''''.

During a third clock interval $\tau_3$, signals representing the $\beta$, $\gamma$, and $\alpha$ components of "a" are provided to the areas 208, 210 and 212, respectively, while only the $\gamma$ component of "b" is provided to area 92''''.

The three detection areas 214, 216, 218 in each cell 96'''' are positioned so that each area intercepts light modulated by particular combinations of the modulation areas. Thus, area 214 intercepts light modulated by areas 208, 92'''', area 216 intercepts light modulated by areas 210 and 92'''', and area 218 intercepts light modulated by areas 212 and 92''''.

The $\alpha$, $\beta$ and $\gamma$ symbols and time lines shown in FIG. 9 indicate for each of the intervals $\tau_1$, $\tau_2$, $\tau_3$, the components provided to each of the modulation areas, as well as the association of the various component products as derived using the definition of products in the polar representation of complex numbers. It will be appreciated by those skilled in the art that the particular cyclic pattern of $\alpha$, $\beta$ and $\gamma$ components provided to the modulation areas is chosen to provide a single component association in the detector areas over the three clock intervals. Accordingly, the detection areas 214, 216, and 218 are always associated with $\alpha$, $\beta$ and $\gamma$ product values, respectively. This mechanization greatly simplifies read-out of data from cells 96'''', which may be accomplished in one clock interval, the data associated with each vector being read in parallel.

Note that while the third and fourth embodiments described above employ tri-vector decomposition of complex numbers, other decomposition schemes may be employed which are within the scope of the invention. For example, complex numbers may be decomposed into two or four components, with the resultant components being processed using the principles described above.

It is also to be noted that while the above examples of the invention describe the multiplication of two matrices, the invention is by no means limited thereto. An expansion of the optical processor architecture to handle more matrices simply requires additional layers of SLMs.

By way of example, FIG. 10 shows the unit cell representation of an optical processor 224 employing space and time multiplexing for processing three matrices containing complex elements. By comparing FIG. 10 with FIG. 9 it will be apparent that the construction of the processor 224 is substantially identical to that of processor 20'''' with the addition of a third SLM represented by unit cell 226. This third SLM may be seen to correspond to SLM 40 in FIGS. 1 and 2.

The processor 224 operates over nine clock intervals, and the details of operation can be readily derived from the $\alpha$, $\beta$ and $\gamma$ designators and time lines in FIG. 10 in view of the previous description of the processor 20''''.

As in the case of the first embodiment of the invention, the third and fourth embodiments just described provide output signals from the detector/accumulator which are not directly proportional to the product of the complex numbers. In a fifth embodiment of the invention 20''''' shown in FIG. 11, a unique combination of space and time multiplexing is employed along with bias signals to provide a complex number optical processor which does not require vector decomposition and which generates output signals which are directly proportional to the product of complex numbers.

Referring to FIG. 11*a*, there is shown the unit cell construction of the processor 20''''' used to multiply a first complex number "a" having real and imaginary parts $a_r$ and $a_i$, respectively. As in the previous embodiments, multiple cells may be employed to parallel process arrays of complex data.

The unit cell 94''''' represents one cell of an SLM such as the SLM 38 described above. Likewise the cell 92''''' represents one cell of an SLM such as SLM 36, and cell 96''''' represents one cell of a detector such as 16, also previously described.

The cell 94''''' is partitioned into two individually addressable light modulation areas 209, 211 which are orthogonal to two individually addressable light modulation areas 213, 215 defined by cell 92'''''. Detector cell 96''''' is partitioned into four light detection areas 217, 219, 221, 223.

The four detection areas 217, 219, 221, 223 in each cell 96''''' are positioned so that each area intercepts light modulated by particular combinations of the modulation areas. Thus, area 217 intercepts light modulated by areas 209 and 213, area 219 intercepts light modulated by areas 211 and 213, area 221 intercepts light modulated by areas 209 and 215 and area 223 intercepts light modulated by areas 211 and 215.

Detector signals accumulated from areas 217 and 219 are applied to positive and negative input terminals, respectively, of a differential amplifier 242. As described earlier with reference to FIG. 1, clock signals from generator 83 may be used to shift data in the detector/accumulator represented by cell 96'''''. In the present embodiment, as described below, data accumulated in areas 217 and 219 provide at amplifier output terminal 244 a signal $d_r$ directly proportional to the real part of the product of complex numbers "a" and "b". Clock signals cause the detector signals accumulated from areas 221 and 223 to be shifted to the positive and negative terminals, respectively, of the amplifier 242, at which time a signal $d_i$ directly proportional to the imaginary part of the product of the complex numbers "a" and "b" is provided at the terminal 244.

Signal processing circuitry, shown in FIG. 11*b*, is provided to generate signals to control modulators 94''''' and 92''''' as follows. A signal representing the real part $a_r$ of a first complex number "a" is provided to the positive input of a summing amplifier 246 and to a negative input terminal of a differential amplifier 248. A positive bias signal $\Delta_3$ is applied to the positive input terminals of the amplifiers 246, 248. Appearing at the output terminal of amplifier 246 is control signal $t_1$ which is equal to $a_r+\Delta_3$. Appearing at the output terminal of amplifier 248 is control signal $t_2$ which is equal to $\Delta_3+a_r$.

A signal representing the imaginary part $a_i$ of the number "a" is provided to a positive input terminal of summing amplifier 250 and to a negative input terminal of differential amplifier 252. Bias signal $\Delta_3$ is provided to the positive input terminals of the amplifiers 250 and 252. Appearing at the output terminal of amplifier 250 is control signal $u_1$ which is equal to $a_i+\Delta_3$. Appearing at the output terminal of amplifier 252 is control signal $u_2$ which is equal to $\Delta_3-a_i$.

A signal representing the real part $b_r$ of a second complex number "b" is provided to the positive input of a summing amplifier 254 and to a negative input terminal of a differential amplifier 256. A positive bias signal $\Delta_4$ is applied to the positive input terminals of the amplifiers 254, 256. Appearing at the output terminal, of amplifier 254 is control signal $v_1$ which is equal to $b_r+\Delta_4$. Appearing at the output terminal of amplifier 256 is control signal $v_2$ which is equal to $\Delta_4+b_r$.

A signal representing the imaginary apart $b_1$ of the number "b" is provided to a positive input terminal of summing amplifier 258 and to a negative input terminal of differential amplifier 260. Bias signal $\Delta_4$ is provided to the positive input terminals of the amplifiers 258 and 260. Appearing at the output terminal of amplifier 258 is control signal $\omega_1$ which is equal to $b_i+\Delta_4$. Appearing at the output terminal of amplifier 260 is control signal $w_2$ which is equal to $\Delta_4-b_i$.

The operation of the processor 20''''' is as follows. During a first clock interval $\tau_1$, as determined by clock generator 83, control signals are provided to cells 94''''' and 92''''' as follows. Control signals $t_2$, $t_1$, $\omega_1$ and $\omega_2$ are applied to modulate areas 209, 211, 215 and 213, respectively. Detector areas 217, 219, 221, and 223 respond to the modulated light and provide detector signals which are accumulated by the accumulator portion of the element 96'''''.

During a second clock interval $\tau_2$, control signals $t_2$, $t_1$, $\omega_2$ and $\omega_1$ are provided to areas 209, 211, 215, and 213, respectively. During a third clock interval $\tau_3$, control signals $u_1$, $u_2$, $v_1$, and $v_2$ are provided to modulate areas 209, 211, 215, and 213, respectively. During a fourth clock interval $\tau_4$, control signals $u_2$, $\omega_1$, $v_2$ and $v_1$ are provided to the areas 209, 211, 215 and 213, respectively. For each of the detector cells 217, 219, 221 and 223, accumulators sum the detector signals generated over the four clock intervals $\tau_1-\tau_4$.

It should be noted that the amplitude of the positive bias signal $\Delta_3$ is chosen to bias the modulator areas 209, 211 at a point which will maintain these areas in their linear light amplitude modulation region over the largest anticipated positive and negative magnitude range of the numbers $a_r$ and $a_i$. Similarly, bias signal $\Delta_4$ is chosen to maintain the areas 213 215 in their linear light amplitude modulation response region over the largest anticipated positive and negative magnitude range of the numbers $b_r$ and $b_i$. The amplitudes of the bias signals $\Delta_3$ and $\Delta_4$ may be equal to each other.

At the completion of the fourth clock interval $\tau_4$, the accumulated data from detector areas 217, 219 are provided to the amplifier 242 as described above. It may be shown that the output signal $d_r$ appearing at the output terminal 244 is proportional to $$d_r=16\Delta_3\Delta_4(a_rb_r-a_ib_i) \qquad (7)$$

Suitable clock signals may be applied to the detector/accumulator, using well known techniques, to shift data accumulated from detector areas 221 and 223 so that this data is now provided as input signals to the amplifier 242. When this occurs, it may be shown that the output signal $d_i$ appearing at the output terminal 244 is proportional to $$d_i = 16\Delta_3\Delta_4(a_r b_r + a_i b_i) \quad (8)$$

Accordingly, the processor 20'''' provides output signals directly proportional to the real and imaginary portions of the product of the complex numbers "a" and "b".

While the above embodiment of the invention describes the multiplication of two numbers, which may be elements of two matrices, the embodiment is by no means limited thereto. An expansion of the optical processor architecture to handle more matrices simply requires additional layers of SLMs, as described previously.

In the instance where it is desirable to multiply two matrices together with a positive number, this may be accomplished with an optical processor having only two SLMs, by making use of the modulation properties of the light source. For example, the second embodiment of the invention, FIG. 7, *a, b,* may be modified to obtain the product of the two matrix elements all, $b_{11}$ and a third positive number c by modulating the intensity of the light source 14 in proportion to the magnitude of the number c. Thus, if the light source 14 is in the form of an LED, the current through the LED can be modulated by a signal proportional to the number c. In this instance, it may be shown that the signal d appearing at the output terminal 232 is modified from that shown in equation 5 to the following:

$$d = 16\Delta_1\Delta_2 c a_{11} b_{11} \quad (9)$$

It will be appreciated that the modulation of the light source may be extended to use in any of the invention embodiments.

As indicated above, it is an object of the present invention to provide optical data processing systems capable of real time processing of synthetic aperture radar data (i.e., SAR data). Processing of the SAR data is currently accomplished by electronic digital processing or film-based optical processing. Digital and optical processing of SAR data is discussed in "Spaceborne Synthetic-Aperture Imaging Radars: Applications, Techniques and Technology," by C. Elachi, T. Bickwell, R. L. Jordan and C. Wu, Proc. IEEE, Vol. 70, No. 10, October, 1982, at pages 1174–1209. Optical processing of SAR data is discussed in the paper entitled "On the Application of Coherent Optical Processing Techniques to Synthetic-Aperture Radar," by L. J. Cutrona, E. N. Leith, L. J. Procello and W. E. Vivian, Proc. IEEE, Vol. 54, No. 8, August, 1966 at pages 1026–32; and *Introduction to Fourier Optics,* by J. W. Goodman, McGraw-Hill Book Company, 1968, at Section 7–7, pages 184–192.

Digital processing results in high quality, high resolution images. The required processing time, however, sometimes precludes real-time operation as, for example, in real time spaceborne applications. Film-based optical processing is also capable of good resolution imagery. The processing is instantaneous once the data film is loaded into the processor. The necessity of film exposure and development, however, also precludes its use in real time applications.

Several schemes have been proposed in the literature for real time optical processing of SAR data, requiring two-dimensional light modulators, a technology which is expensive and not yet fully developed.

One such approach described in "An Electro-Optical Signal Processing Module," K. Bromley, et al., Proc. 80 SPIE, Washington, D.C., April, 1979, p. 205 et seq., utilizes a linear array of light emitting diodes ("LEDs") a two-dimensional SLM and a two-dimensional scroll and integrate detector array to perform a matrix-matrix multiplication. The system is understood to be capable of implementing a space variant Doppler filter set to perform azimuth processing. The range processing, however, must be done externally, and azimuthal resolution is limited by the number of LEDs in the linear array and by optical crosstalk at the detector.

Another such approach described in "High Speed Techniques for Synthetic Aperture Radar Image Formation," D. Psaltis, et al., NASA Conference Publication 2207, Optical Information Processing for Aerospace Applications, Aug. 18–19, 1981, p. 47 et seq., involves replacement of the film in the conventional optical processor by a two dimensional SLM such as a Pockels readout optical modulator. A CRT addresses the SLM and coherent readout is used. Such a system is necessarily complicated and includes many lenses in addition to the two-dimensional SLM, making alignment difficult. Further, the system is apparently not easily programmable in real time to compensate for varying conditions. This reference also describes another approach which utilizes an acoustooptic cell, anamorphic optics, a two-dimensional mask, and a shift-and-integrate CCD detector array. Radar return data is input into a one-dimensional acoustooptic cell. Range correlation is then performed on the data spatially using a cylindrical lens. A two-dimensional transmission mask contains the azimuth correlation functions. As data is shifted and integrated in the CCD detector array, the system acts as a time-domain azimuth correlator. Difficulties with this approach include the need for coherent light, anamorphic optics, and non-programmability if a fixed two-dimensional mask is used. Programmability requires the use of expensive two-dimensional spatial light modulators.

The preferred embodiment of this invention is directed to solution of the problem of achieving real time optical processing of SAR data. FIG. 12 is a diagrammatic illustration of an SAR mounted on a moving platform (such as an aircraft or spacecraft) above the ground. With the platform moving in a direction parallel to the ground track and at a known altitude, a sequence of radar pulses is generated with the radar returns being processed to synthesis a large aperture with very high resolution in azimuth and range.

The SAR processing problem can be described as a space variant linear transformation in the two dimensions of range (u) and azimuth (v):

$$f(x,y) = \int\int F(u,v)H(u-x,y)G(v-y,y)dudv \quad (10)$$

where F(u,v) is the SAR return data, and H(u−x,y) and G (v−y,y) are the space variant correlation functions in azimuth and range, respectively. The function F(u,v) is a real positive quantity which represents the pattern drawn on a CRT by the radar returns. For a point target, the return F(u,v) is a chirp in both range and azimuth described by $\cos(au^2+bv^2)$, where a and b are constants.

The chirp in range is due to time modulation of the transmitter radar pulse. The chirp in azimuth is due to Doppler shifts caused by the relative motion between the radar and the target. Time modulation of the transmitted waveform is conventionally employed in SAR systems to lessen the peak power loading of the SAR transmitter.

As given by *Elachi et al.*, i.d. at page 1176, an example of a linearly phase-modulated transmitted waveform W(t) is:

$$W(t)=A(t)e^{i[\omega_o+(a/2)t^2)]} \quad (11)$$

where

A(t)=1, for $nT-\tau<t<nT+\tau$
A(t)=0 otherwise;
T=pulse repetition period;
$2\tau$=pulse length;
$\omega_o$=carrier frequency;
a=chirp rate; and
n=integer.

As given by Eq. 9 of Elachi et al., i.d. at 1176, the return signal E(t) from a point target is delayed in time by a phase shift $\phi(t)$ proportional to the round trip delay:

$$E(t)=A(t-2r/c)e^{i[\omega_o t+(a/2)(t-2r/c)^2+\phi(t)]} \quad (12)$$

where $$\phi(t)=2\omega_o(h^2+(x(t)-x_1)^2+y_1^2)^{\frac{1}{2}}/c=(2\omega_o r)/c,$$

h=altitude of moving platform;
x(t)=Vt=azimuth of moving target;
$x_i$=azimuth of target;
$y_i$=range of target;
V=speed of the SAR moving platform; and
c=speed of light; and
r=distance between the SAR moving platform and the point target.

The SAR radar return from a point target in general has a behavior chirped in both azimuth and range, resulting in a deformed Fresnel zone plate distribution. Neglecting the effects of Doppler offset due to the Earth's rotation or motion of targets on the ground, range walk and range curvature, the return will be a simple elliptical zone plate as shown in FIG. 4 of Elachi et al., i.d.

The chirp in azimuth is in general a function of the range of the target, necessitating a space variant correlation represented by Eq. 10. In order to process an N×N image represented by a matrix of N pixel rows by N pixel columns to perform this correlation, $N^4$ multiplications must be performed.

FIG. 12 illustrates the moving SAR platform, and the relation to the point target at $x_1$, $y_1$. As illustrated, r is the distance between the SAR platform and the point target $r_1=(h^2+y_1^2)^{\frac{1}{2}}$ is defined as the slant range to the point target. Then, $$\begin{aligned}\phi(t) &= 2\omega_o(r_1^2+(x-x_1)^2)^{\frac{1}{2}}/c \\ &= 4\pi\,(r_1^2+(x-x_1)^2)^{\frac{1}{2}}/\lambda\end{aligned} \quad (13)$$

where $\lambda$ is the radar wavelength.

The radar return E(t), which consists of a series of chirped pulses with different phase shifts, can be plotted as a function of two variables. One variable is the time at which each pulse s transmitted, given by nT (the time origin of each pulse). The second variable in the delay time t' with respect to the time of origin of each pulse, i.e. with t' having a value ranging between O and T. The variable t' is periodic, repeating every T seconds. Thus, the total elapsed time $t=nT+t'$. FIG. 13 is a three-dimensional plot showing E(t', nT) as a function of t' and nT.

$$\begin{aligned}E(t',nT) &= A(t'-2r_1/c)[\cos((a/2\,(t'-2r_1/c)^2) \\ &\quad \cos((4\pi/\lambda)\,(r_1^2+(VnT-x_1)^2)^{\frac{1}{2}}- \\ &\quad \sin((a/2)\,(t'-2r_1/c)^2)\sin((4\pi/\lambda) \\ &\quad (r_1^2+(VnT-x_1)^2)^{\frac{1}{2}} \\ &= C_1-S_1\end{aligned} \quad (14)\ (15)$$

Thus, the return signal of Eq. 14 consists of two terms, the first ($C_1$) involving cosine functions and the second ($S_1$) involving sine functions. For simplicity, correlation of only the first term $C_1$ will be described in detail, it being understood that the correlation for the second terms $S_1$ will be performed in a similar manner, except that the sine function will replace the cosine function. The difference between the respective correlations for $C_1$ and $S_1$ will then represent the full correlation of E(t', nT). In practice, however, for many applications, performing only the cosine term correlation may provide satisfactory operation; performing the additional correlation for the sine term will increase the signal to noise ratio of the correlated data.

The azimuth dimension naturally divides into bins of width VT. Dividing the range dimension into M bins of width $T_Rc/M$, where $T_Rc$ is the maximum range and $T_R$ is less than T, term $C_1$ can be written as $$\begin{aligned}C_1=&A(t'-2m_1T_R/M)\cos[(a/2)(t'-2m_1T_R/M)^2] \\ &\cos[(4\pi/\lambda)(((m_1T_Rc/M)^2+(VnT-x_1)^2)^{\frac{1}{2}}]\end{aligned} \quad (16)$$

where $m_1T_Rc/M$ is the target range.

The reference range and azimuth correlation functions $G_m(t')$ and $H_n(t')$ for a point target are given by $$G_m(t')=A(t'-2mT_R/M)\cos[(a/2)(t'-2mT_R/M)^2] \quad (17)$$

$$H_n(t')=\cos[(4\pi/\lambda)((t'c/2)^2+(nVT)^2)^{\frac{1}{2}} \quad (18)$$

A block diagram of a preferred embodiment of an optical SAR processor 300 is disclosed in FIG. 14. The optical processor 300 has a basic triple layer architecture of two one-dimensional electro-optic modulators 330, 340 and a two-dimensional detector array 350, as described above with respect to FIG. 6.

Samples representing the demodulated radar return signal E(t) are clocked into charge coupled (CCD) device delay line 310 at a high clock frequency $\phi_1$. The return from a single transmitted pulse is therefore characterized by $N_D$ analog data samples, each sample taken at time intervals $1/\phi_1$ over the period $T_R$ from emission of the pulse. The number of samples $N_D$ is at least as large as M, the number of range bins, and preferably larger.

The $N_D$ return samples are clocked out of the device 310 at a much lower clock rate $\phi_2$ to time modulate the input LED light source 320. Of course, other light sources may be employed, such as a laser diode. The LED light source preferably includes a diffuser (not shown) to grade the light produced by the LED into a spatially uniform optical beam which illuminates the first layer 330 of one-dimensional electro-optic modulators. The range correlation function spatially modulates the modulators comprising layer 340. The range correlation function also varies with time, the function values being clocked at the $\phi_2$ clock rate.

Underneath the first layer 330 of modulators is a second layer 340 of modulators disposed in parallel to the first layer 330, with the modulators forming the second layer 340 oriented orthogonally to the modulators comprising the first layer 330. The azimuth correlation function spatially modulates the modulators comprising layer 340. The range correlation function also varies with time, the function values being clocked at the $\phi_2$ clock rate.

At the bottom of the processor assembly 300 is an accumulator array 350, in this embodiment comprising a shift and integrate CCD detector array with serial readout. An exemplary commercial device which is suitable for use as detector array 350 is the Philips Model NXAI030 frame transfer sensor marketed by the Slatersville division of the Amperex Electronic Corporation, Slatersville, R.I. 02876.

The array 350 is arranged as a matrix of 2M rows (for the embodiment capable of handling bipolar numbers) and N columns of photosensitive cells capable of converting incident light intensity into a corresponding charge packet. The array 350 is clocked at $\phi_2/N_D$, the radar pulse repetition frequency (PRF), with the charge packet of the nth cell of each row being shifted to the (n+1)th cell at each clock cycle. The array therefore produces N−1 intermediate sums, and after the Nth clock cycle, with the N return pulses having modulated the input light beam, the Nth column of data has the final sums representing the fully correlated data for that set of N pulse return samples.

Polarizers between the layers have been omitted from FIG. 14.

The light intensity at the detector array 350 is proportional to the triple product of the LED intensity and the control voltages applied to the two electrooptic modulator layers 330 and 340. The clocking frequency of the CCD detector array 350 is matched to the radar PRF. Bipolar numbers are represented using space and time multiplexing as described above with respect to FIG. 7.

The clock rate $\phi_1$ at which input data samples are clocked into the CCD device 310 is selected in accordance with the Nyquist sampling criterion to capture the expected spectral content of the return signal E(t). Since the signal E(t) will typically have a spectral content comprising significant high frequency components, the clock rate $\phi_1$ will typically be quite high. The CCD device output clock rate $\phi_2$ is much lower than the input rate $\phi_1$ to avoid having to operate the light modulators comprising layers 330, 340 at a very high clock rate (beyond their capability), but must still be rapid enough to empty the delay line of stored "old" samples before new data samples are clocked into the device. The output clock rate $\phi_2$ thus is limited by the PRF and the length of each pulse.

The values selected for the PRF, $\phi_1$, and $\phi_2$, will depend on the application. By way of example, for an application wherein the maximum range is 50 kilometers and the required resolution is 5 meters, the PRF may be 3 Khz, the input clock rate $\phi_1$ may be 30 Mhz, and the lowest output clock rate $\phi_2$ is $N_D$ times the PRF.

The operation, the range correlation functions $G_m(t')$ (which can be range variant) are provided one for each of the M range bins. These functions control each of the respective modulators comprising layer 330, so that the correlation peak in time corresponding to the range of a point target occurs in the correct spatially segregated range bin. The range correlation is performed in time and the correlation peaks are separated spatially along the range dimension into the M range bins.

As the CCD detector array 350 shifts and integrates, the azimuth correlation with the azimuth reference function $H_n(t')$ is performed spatially. The time variation of $H_n(t')$ is used to compensate for the dependence of the azimuth correlation function on the range of the point target.

The output imagery is scrolled out one azimuth line at a time every $N_D$ clock cycles of $\phi_2$. A serial output register 360 couples the serial data from array 350 to the inverting and noninverting inputs of differential amplifier 370. Thus, 2M samples of the data are serially read out of the array 350, with each block of two data samples representing the negative and positive components of the correlated data for that range and azimuth cell.

The serial output register 360 is not necessary for the commercial embodiment of the array 350 described above. That device provides three separate output registers, and two of the registers may be assigned to the respective positive and negative components.

This fully programmable system performs $N^2MND$ analog multiplications in $N_DN$ clock cycles of $\phi_2$, or one line of range data is output every $N_D$ clock cycles. In order to process a 256×256 pixel frame every 30 milliseconds (video rates) the basic clock rate of the modulators is 2.2 MHz and a new azimuth line is clocked out of the detector array at a rate of 8.5 Khz, values which are not unreasonable to implement.

The bipolar number representation discussed above eliminates errors due to both constant and signal related bias errors. In addition, it is possible to compensate for the nonlinearity of the electro-optic modulators by modifying the G and H functions accordingly.

To further illustrate the operation of the modulator layers 330 and 340 and the detector array 350, FIG. 15 depicts the reference correlation functions G and H and the accumulated sums at the array 350 at one point in time. For the case wherein $N_D$ return data samples are collected in the CCD delay line 310 for each transmitted radar pulse, and the range resolution is divided into M range bins, the operation of the modulator layers 330 and 340 and accumulator/detector array 350 perform the following operation:

$$I_{pq} = \sum_{n}^{N} \sum_{m}^{N_D} H_{nm} G_{mq} E_{n+p,m} \tag{19}$$

where:

$$\begin{aligned} H_{nm} &= \cos[(4\pi/\lambda)(((mT_Rc/2M)^2 + (nVT)^2)^{\frac{1}{2}}]; \\ G_{mn} &= A(mT_R/M - 2nT_R/M)\cos[(a/2)(mT_r/M - \\ &\quad 2nT_R/M)^2]; \\ &= A((T_R/M)(m-2n))\cos[(a/2)(T_R)/M)^2(m-2n)^2]; \end{aligned}$$

q is the range index, $1<q<M$;

p is the azimuth index, $1<p<\infty$; and $I_{pq}$ is the correlated output scrolled in azimuth.

Referring to FIG. 15, register 331 holds the values for the range reference correlation function $G_{mn}$ and register 341 holds the values for the azimuth reference correlation function $H_{nm}$. For simplicity, the bipolar number representation is omitted from FIG. 15. Thus, during the first $\phi_2$ clock cycle, the M one-dimensional modulators comprising layer 330 are modulated respectively by the values $G_{11}$–GM1. The N modulators comprising layer 340 are modulated by the values $H_{11}$–$H_{N1}$.

For the next $N_D$ clock cycles of $\phi_2$, the respective contents of registers 331 and 341 are input to the modulators as shown in FIG. 15. During this period, the contents of the detector array 350 are not shifted and the incident light is integrated in place. After $N_D$ clock cycles, the contents of the respective cells in each column of array 350 are shifted to the corresponding cell in the next adjacent column and the integration repeated in place for the next $N_D$ clock cycles of $\phi_2$.

The values of the Nth column of the detector array 350 are continuously scrolled out, representing a line of correlated data for each azimuth value.

The correlation function implemented by the optical processor 300 is formed by crossing two one-dimensional modulators, i.e., providing the outer product multiplication of two vectors, forming a matrix. Thus, the correlation (or matched filter function in terms of Fourier analysis) is rectilinear. As a result, there is some slight loss of performance resulting from the elliptical zone plate nature of the point target return. Analysis indicates that the signal-to-noise ratio of the correlation between a retilinear zone plate and an elliptical zone plate is only slightly less than the correlation between two elliptical zone plates.

An elliptical zone plate correlation can be implemented and the signal-to-noise ratio improved by utilizing two processors 300' and 300'' in tandem, as shown in FIG. 16. Both processors are identical except that processor 300' calculates the $C_1$ term of Eq. 15 while processor 300'' calculates the $S_1$ term. Thus, the reference functions driving the modulators 330' and 340' are for the $C_1$ term, and the reference functions driving the modulators 330'' and 340'' are for the $S_1$ term. The respective outputs $I_c(p,q)$ and $I_s(p,q)$ of the two processors are subtracted using differential amplifier 380, resulting in the final accurately correlated output I(p,q).

The effects of Doppler offset, range walk and range curvature become significant for spaceborne SAR systems. Doppler offset is due to relative motion between the point target and the SAR moving platform due to the Earth's rotation or nonstationary point targets. This effect can be simply compensated in the processor 300 by adjusting the azimuth correlation function and making it asymmetric.

Range walk is the difference in range of a point target when it leaves the radar beam relative to when it enters the beam. Range walk can be compensated by rotating the detector array relative to the range and azimuth electro-optic layers.

Range curvature is caused by the non-neglible change in range of the point target as it passes through the radar beam. This effect can be compensated by rotating the range correlation modulator layer 330 relative to the azimuth layer 340 and detector array 350.

While there has been shown and described preferred embodiments of the invention, it is to be understood that various adaptations and modifications may be made which are within the scope of the invention.

What is claimed is:

1. An apparatus for optically processing positive and negative numbers, comprising:

first modulator means for spatially modulating an optical beam in response to a first signal that represents a first number and having first and second modulation areas;

second modulator means for spatially modulating the optical beam exiting the first modular means in response to a second signal that represents a second number, and having third and fourth modulation areas where the third and fourth modulation areas each intercept light modulated by both the first and second modulation areas;

light detector means having four light detection areas, the first detection area responsive to light modulated by the first and third modulation areas, the second detection area responsive to light modulated by the second and third modulation areas, the third detection area responsive to light modulated by the first and fourth modulation areas, and the fourth detection area responsive to light modulated by the second and fourth modulation areas; and control means for enabling the first signal to modulate the beam at the first modulation area if the first number is positive and to modulate the beam at the second modulation area if the first number is negative, where the degree of modulation at the first and second modulation areas is proportional to the magnitude of the first number, and for enabling the second signal to modulate the beam at the third modulation area if the second number is positive and to modulate the beam at the fourth modulation area if the second number is negative, where the degree of modulation at the third and fourth modulation areas is proportional to the magnitude of the second number.

2. The apparatus of claim 1 where the first and second modulation areas are in the form of adjacent strips extending in a first direction, and the third and fourth modulation areas are in the form of adjacent strips extending in a second direction orthogonal to the first direction.

3. An optical processor for multiplying positive and negative numbers, comprising:

first modulator means for spatially modulating an optical beam in response to a first signal that represents a first number and having first and second modulation areas;

second modulator means for spatially modulating the optical beam in response to a second signal that represents a second number and positioned so that the beam is modulated both by the first and second modulator means, and having a third modulation area which modulates the same portion of the beam modulated by both the first and second modulation areas;

light detector means having two light detection areas, the first detection area providing a first detector signal responsive to light modulated by the first and third modulation areas, and the second detection area providing a second detector signal responsive to light modulated by the second and third modulation areas;

signal processing means for providing four control signals, where the first control signal is the sum of a first bipolar number and a first positive bias signal, the second control signal is the difference between the first bias signal and the first bipolar number, the third control signal is the sum of a second bipolar number and a second positive bias signal, and the fourth control signal is the difference between the second bias signal and the second bipolar number;

control means for controlling the optical processing of the first and second numbers in a first interval of time by enabling the first control signal to modulate the beam at the first modulation area, enabling the second control signal to modulate the beam at the second modulation area, and enabling the third control signal to modulate the beam at the third modulation area, and for controlling the optical processing of the first and second numbers in a second interval of time by enabling the second control signal to modulate the beam at the first modulation area, enabling the first control signal to modulate the beam at the second modulation area, and enabling the fourth control signal to modulate the beam at the third modulation area, where the degree of modulation of the modulation areas is proportional to the magnitude of the respective control signals;

accumulator means for summing the first detector signal provided in the first interval of time with the first detector signal provided in the second interval of time to yield a first summed signal, and for summing the second detectors signal provided in the first interval of time with the second detector signal provided in the second interval of time to yield a second summed signal; and difference means for subtracting the second summed signal from the first summed signal to provide an output signal directly proportional to the product of the first and second bipolar numbers.

4. The processor of claim 3 in which the first and second bias signals are equal to each other.

5. The processor of claim 3 in which the intensity of the optical beam is proportional to a third positive number, whereby the output signal is directly proportional to the product of the first, second and third numbers.

6. An apparatus for optically processing complex numbers, comprising:

processing means for decomposing a first complex number into three real positive valued signal components, $\alpha_1$, $\beta_1$, $\gamma_1$, respectively, and for decomposing a second complex number into three real positive-valued signal components $\alpha_2$, $\beta_2$, $\gamma_2$, respectively;

first modulator means for spatially modulating an optical beam in response to the signal components $\alpha_1$, $\beta_1$, $\gamma_1$ and having first, second and third modulation areas;

second modulator means for spatially modulating the optical beam exiting the first modulator means in response to the signal components $\alpha_2$, $\beta_2$, $\gamma_2$ and having fourth, fifth and sixth modulation areas;

light detector means having nine light detection areas, the first detection area responsive to light modulated by the first and fourth modulation areas, the second detection area responsive to light modulated by the first and fifth modulation areas, the third detection area responsive to light modulated by the first and sixth modulation areas, the fourth detection area responsive to light modulated by the second and fourth modulation areas, the fifth detection area responsive to light modulated by the second and fifth modulation areas, the sixth detection area responsive to light modulated by the second and sixth modulation areas, the seventh detection area responsive to light modulated by the third and fourth modulation areas, the eighth detection area responsive to light modulated by the third and fifth modulation areas, and the ninth detection area responsive to light modulated by the third and sixth modulation areas; and control means for enabling the signal components $\alpha_1$, $\beta_1$, $\gamma_1$ to modulate the beam at the first, second and third modulating areas, respectively, and for enabling the signal components $\alpha_2$, $\beta_2$, $\gamma_2$ to modulate the beam at the fourth, fifth and sixth modulation areas, respectively, where the degree of modulation at each modulation area is proportional to the magnitude of the respective component.

7. The apparatus of claim 6 where the first, second and third modulation areas are in the form of adjacent strips extending in a first direction, and the fourth, fifth and sixth modulation areas are in the form of adjacent strips extending in a second direction orthogonal to the first direction.

8. An optical processor for multiplying complex numbers comprising;

first modulator means for spatially modulating an optical beam in response to signals that represent the real and imaginary parts of a first complex number and having first and second modulation areas;

second modulator means for spatially modulating the optical beam exiting the first modulator means in response to signals that represent the real and imaginary parts of a second complex number, and having third and fourth modulation areas where the third and fourth modulation areas each intercept light modulated by both the first and second modulation areas;

light detector means having four light detection areas, the first detection area providing a first detector signal responsive to light modulated by the first and third modulation areas, the second detection area providing a second detector signal responsive to light modulated by the second and third modulation areas, the third detection area providing a third detector signal responsive to light modulated by the first and fourth modulation areas, and the fourth detection area providing a fourth detection signal responsive to light modulated by the second and fourth modulation areas;

signal processing means for providing light control signals, where the first control signal is the sum of the signals of the real part of the first complex number and a first positive bias signal, the second control signal is the difference between the first bias signal and the signal of the real part of the first complex number, the third control signal is the sum of the signal of the imaginary part of the first complex number and the first bias signal, the fourth control signal is the difference between the first bias signal and the signal of the imaginary part of the first complex number, the fifth control signal is the sum of the signal of the real part of the second complex number and a second positive bias signal, the sixth control signal is the difference between the second bias signal and the signal of the real part of the second complex number, the seventh control signal is the sum of the signal of the imaginary part of the second complex number and the second bias signal, and the eighth control signal is the difference between the second bias signal and the signal of the imaginary part of the second complex number;

control means for controlling the optical processing of the signals that represent the first and second complex numbers in a first interval of time by enabling the first, second, eighth and seventh control signals to modulate the beam at the first, second, third and fourth modulation areas, respectively, for controlling the processing of the signals that represent the complex numbers in a second interval of time by enabling the second, first, seventh and eight control signals to modulate the first, second, third and fourth modulation areas, respectively, for controlling the processing of the signals that represent the complex numbers in a third interval of time by enabling the third, fourth, sixth and fifth control signals to modulate the first, second, third and fourth modulation areas, respectively, and for controlling the processing of the signals that represent the complex numbers in a fourth interval of time by enabling the fourth, third, fifth and sixth control signals to modulate the first, second, third and fourth modulation areas, respectively;

accumulator means for summing together the first detector signals provided in each of the four intervals of time to yield a first summed signal summing together the second detector signals provided in each of the four intervals of time to yield a second summed signal, summing together the third detector signals provided in each of the four intervals of time to yield a third summed signal, and for summing together the fourth detector signals provided in each of the four intervals of time to yield a fourth summed signal; and difference means for subtracting the second summed signal from the first summed signal to provide an output signal directly proportional to the real part of the product of the two complex numbers, and for subtracting the fourth summed signal from the third summed signal to provide a second output signal directly proportional to the imaginary part of the product of the two complex numbers.

9. The processor of claim 8 in which the first and second bias signals are equal to each other.

10. The processor of claim 8 in which the intensity of the optical beam is proportional to a third positive number, whereby the first output signal is directly proportional to the real part product of the first, second and third numbers and the second output signal is directly proportional to the imaginary part product of the first, second and third numbers.

11. An apparatus for optically processing complex numbers, comprising:

processing means for decomposing a first complex number into three real positive-valued signal vectors $\alpha_1$, $\beta_1$, $\gamma_1$, respectively, and for decomposing a second complex number into three real positive-valued signal vectors $\alpha_2$, $\beta_2$, $\gamma_2$, respectively;

first modulator means for spatially modulating an optical beam in response to the signal vectors $\alpha_1$, $\beta_1$, $\gamma_1$ and having first, second and third modulation areas;

second modulator means for spatially modulating an optical beam in response to the signal vectors $\alpha_2$, $\beta_2$, $\gamma_2$ and having fourth modulation area;

light detector means having three light detection areas, the first detection area responsive to light modulated by the first and fourth modulation areas, the second light detection area responsive to light modulated by the second and fourth modulation areas, and the third detection area responsive to light modulated by the third and fourth modulation areas; and control means for controlling the optical processing of the complex numbers in a first interval of time by enabling the signal vectors $\alpha_1$, $\beta_1$, and $\gamma_1$ to modulate the beam at the first, second, and third modulation areas, respectively, and to enable the signal vector $\alpha_2$ to modulate the beam at the fourth modulation area, for controlling the optical processing of the complex numbers in a second interval of time by enabling the signal vectors $\alpha_1$, $\beta_1$, $\gamma_1$ to modulate the beam at the second, third and first modulation areas, respectively, and to enable the signal vector $\beta_2$ to modulate the fourth modulation area, and for controlling the optical processing of the complex numbers in a third interval of time by enabling the signal vectors $\alpha_1$, $\beta_1$, and $\gamma_1$ to modulate the beam at the third, first and second modulation areas, respectively, and to enable the signal vector $\gamma_2$ to modulate the fourth modulation area, where the degree of modulation of the first through fourth modulation areas is proportional to the magnitude of the respective signal vector modulating that area.

12. An optical processor for real-time optical processing of synthetic aperture radar (SAR) return signals, comprising:

means for sourcing noncoherent light to provide a spatially uniform input light beam;

means coupled to said light sourcing means for time modulating the intensity of said light beam in accordance with data representative of said SAR return signals;

first spatial light modulating means for spatially modulating said input light beam along a range axis in response to range correlation reference signals;

second spatial light modulating means for spatially modulating the light beam exiting said first spatial modulating means along an azimuth axis in response to azimuth correlation reference signals, said first and second light modulators oriented such that said range and azimuth axes are crossed;

a light detector array comprising a matrix of light detectors arranged in optical alignment with the light beam exiting said second spatial light modulating means, each of said detectors for providing a detector signal representative of the light intensity incident thereon, said array adapted to perform a shift and integrate function along the detectors of each row along said azimuth axis in correspondence with the data modulating said light source means and to provide a series of output data values representative of image data in the range and azimuth dimensions.

13. The processor of claim 12 wherein said light sourcing means comprises a light emitting diode.

14. The processor of claim 12 wherein said light sourcing means comprises a laser diode.

15. The processor of claim 12 wherein said time modulating means comprises a means for varying the intensity of the light produced by said light sourcing means in dependence on said SAR return signals.

16. The processor of claim 15 wherein said time modulating means comprises means for providing a sequence of $N_D$ data samples representing the SAR return signals from a transmitted SAR pulse, and wherein said intensity varying means is responsive to said sequence of $N_D$ data samples.

17. The processor of claim 16 wherein said means for providing a sequence of $N_D$ data samples comprises:

a shift register device having $N_D$ serially connected stages;

means for serially inputting said $N_D$ data samples into said shift register device at a first clock rate, said first clock rate selected to capture the spectral content of said SAR signals; and means for serially outputting said $N_D$ data samples from said shift register device at a second clock rate which is slower than said first clock rate.

18. The processor of claim 17 wherein the respective range and azimuth correlation reference signals vary as a function of the time from transmittal of said pulse at said second clock rate.

19. The processor of claim 12 wherein said first light modulating means comprises a first planar layer of one-dimensional light modulators defining aligned strip regions in said layer whose respective transmissivities vary as a function of the magnitude of the respective range correlation reference signals.

20. The processor of claim 19 wherein said second light modulating means comprises a second planar layer of one-dimensional light modulators defining aligned strip regions in said layer whose respective transmissivities vary as a function of the magnitude of the respective azimuth correlation reference signals, and wherein said first and second layers are arranged in a stacked, substantially parallel relationship.

21. An optical processor for optically processing synthetic aperture radar (SAR) return signals to provide image signals correlated in range and azimuth dimensions, comprising:

means for sequentially providing a plurality $N_D$ of return samples representing the SAR return signals from a transmitted SAR pulse;

means for sourcing light to provide a spatially uniform light beam;

means coupled to said light sourcing means and said sample providing means for modulating the intensity of said light beam during a first time interval by a sequence of $N_D$ modulating signals representative of said plurality of return samples;

first spatial light modulating means for spatially modulating said light beam along a range dimension axis in response to range correlation reference signals;

second spatial light modulating means for spatially modulating the light beam along an azimuth dimension axis in response to azimuth correlation reference signals, said first and second spatial light modulating means oriented such that said range and azimuth axes are crossed;

a light detector array comprising a matrix of light detectors arranged in M rows and N columns of light detectors in optical alignment with said light beam exiting said first and second light modulating means, said light detectors provided at an array density equivalent to the effective resolution of the optical processor, each of said light detectors providing a detector signal responsive to light modulated by said first and second light modulating means;

accumulator means operatively coupled to said respective light detectors for summing the respective detector signals over said first time interval to provide accumulated detector signals representative of partial sums of the respective products of said modulating signals, said range correlation reference signals and said azimuth correlation reference signals over said first time interval;

means for shifting said respective accumulated detector signals along the azimuth axis to the next adjacent light detector in response to an array clock signal at a rate at least equal to the SAR pulse repetition rate; and means for providing the respective accumulated detector signals of the Nth column of light detectors as SAR image data signals representative of the correlated SAR image at predetermined range and azimuth cells.

22. The optical processor of claim 21 wherein said first light modulating means comprises a first planar layer of M one-dimensional light modulators defining aligned strip regions in said layer whose respective transmissivities vary as a function of the magnitude of the respective range correlation function values for M range bins, and further comprising means for sequentially modulating said respective M light modulators with $N_D$ sequential range correlation values in synchronism with said light source modulating signal means.

23. The optical processor of claim 22 wherein said second light modulating means comprises a second planar layer of N one-dimensional light modulators defining aligned strip regions in said layer whose respective transmissivities vary as a function of the magnitude of the respective azimuth correlation reference signals for N azimuth bins, and further comprising means for sequentially modulating said respective N light modulating means with $N_D$ respective sequential azimuth correlation signal values in synchronism with said light source modulating means.

24. The optical processor of claim 23 wherein said respective means for modulating said light sourcing means, said respective M light modulators and said respective N light modulators are clocked at a clock rate $\phi_2$.

25. The optical processor of claim 24 wherein said detector array clock signal rate is $\phi_2/N_D$.

26. The optical processor of claim 21 wherein said light sourcing means comprises a light emitting diode.

27. The optical processor of claim 21 wherein said means for providing a plurality $N_D$ of return samples comprises:

analog shift register device having $N_D$ serially connected stages;

means for sampling said SAR return signals at an input clock rate selected to capture the desired spectral content of said SAR signals and sequentially loading $N_D$ samples into said shift register device stages; and means for serially outputting said $N_D$ samples from said shift register device at said first clock rate.

28. An optical processor for optically processing synthetic aperture radar (SAR) return signals from SAR pulses transmitted at a predetermined pulse repetition frequency comprising:

means for providing $N_D$ analog samples representing the SAR return signals;

means for sampling the SAR return signals to provide $N_D$ analog data samples representing the SAR return for each transmitted SAR pulse, said sampling means operating at first clock rate selected to capture the desired spectral content of said SAR return signals;

means for sourcing light to provide a spatially uniform light beam;

means coupled to said light sourcing means for modulating the intensity of said light beam at a second clock rate during a predetermined time interval no greater in duration than the SAR interpulse-period, said modulating means for sequentially modulating the intensity of said light beam by the respective magnitudes of said respective $N_D$ samples;

a first planar array of M one-dimensional light modulators defining aligned strip regions in said layer whose respective transmissivities vary as a function of the magnitude of the respective range correlation reference values for M range bins;

means for sequentially modulating at said second clock rate said M one-dimensional light modulators with a matrix G of range correlation reference values arranged in M rows and $N_D$ columns;

a second planar array of N one-dimensional light modulators defining aligned strip regions in said second layer whose respective transmissivities vary as a function of the magnitude of the respective azimuth correlation reference values for N azimuth bins;

means for sequentially modulating at said second clock rate said N one-dimensional light modulators with a matrix H of azimuth correlating reference values arranged in N rows and $N_D$ columns; and an accumulator array comprising:

(i) a matrix of light detector cells arranged in M rows and N columns in optical alignment with said light beam exiting said first and second arrays of one-dimensional light modulators, each of said light detector cells providing a detector signal responsive to light modulated by said first and second arrays;

(ii) accumulator means for summing the respective detector signals over said first time interval to provide accumulated detector signals representative of the sums of the triple product of said $N_D$ sample values and the respective G and H reference correlation matrices:

(iii) means for shifting said accumulated detector signals at a third clock rate at least as fast as the SAR pulse repetition frequency row-wise along said azimuth axis to the next adjacent detector cell to be summed by said accumulator means with the respective accumulated detector signal for the next successive first time interval wherein said $N_D$ samples represent the radar returns from the next transmitted pulse; and (iv) means for shifting out the respectie accumulated detector signals for the Nth column of detector cells, said detector signals representing SAR image data for a particular azimuth bin and M respective range bin cells correlated over N transmitted pulses.

* * * * *